US005427156A

United States Patent [19]

Saito

[11] Patent Number: 5,427,156

[45] Date of Patent: Jun. 27, 1995

[54] COTTON FABRIC MADE FROM SPUN YARNS OF HIGH FIBER LENGTH AND FINENESS

[75] Inventor: Minoru Saito, Otsu, Japan

[73] Assignee: Toyo Boseki Kabushiki Kaisha, Osaka, Japan

[21] Appl. No.: 215,618

[22] Filed: Mar. 22, 1994

[30] Foreign Application Priority Data

| | | | |
|---|---|---|---|
| Mar. 26, 1993 | [JP] | Japan | 5-068451 |
| Apr. 19, 1993 | [JP] | Japan | 5-091511 |
| Apr. 28, 1993 | [JP] | Japan | 5-103037 |
| Jun. 14, 1993 | [JP] | Japan | 5-142139 |
| Jun. 17, 1993 | [JP] | Japan | 5-146326 |

[51] Int. Cl.[6] ..... D03D 15/00

[52] U.S. Cl. ..... 139/420 B; 139/420 R; 139/426 R; 428/225; 57/252; 66/202

[58] Field of Search ..... 66/202; 139/420 R, 426, 139/420 B; 28/155; 428/225; 57/252; 2/243.1

[56] References Cited

U.S. PATENT DOCUMENTS

| | | | |
|---|---|---|---|
| 3,287,788 | 11/1966 | Goodbar et al. | 28/155 |
| 4,670,326 | 6/1987 | Heiman | 139/426 R X |
| 4,900,613 | 2/1990 | Green | 428/225 |
| 5,313,774 | 5/1994 | Matsumoto et al. | 139/420 R |

*Primary Examiner*—Andrew M. Falik
*Attorney, Agent, or Firm*—Foley & Lardner

[57] ABSTRACT

A woven or knitted cotton fabric having a supple and flexible hand made of a spun yarn of 5's to 250's English count including cotton fibers; each of which has an effective fiber length of at most 1.8 inches and a micronaire fineness of at most 3.8 μg/inch; the average of bending rigidity values (B) in the warp or wale direction and weft or course direction of the fabric as measured by a KES-FB2 tester being in the range of 0.002 to 0.100 gf.cm$^2$/cm; and the average of shear stiffness values (G) in the warp or wale direction and weft or course direction of the fabric as measured by a KES-FB1 tester being in the range of 0.2 to 1.70 gf/cm.degree.

6 Claims, 8 Drawing Sheets

OC = 1/2 OA OE = 1/4 OD' EF = 1/2 EE' OH = 1/4 OG'

EFFECTIVE FIBER LENGTH = HH'

COTTON FABRIC MADE FROM SPUN YARNS OF HIGH FIBER LENGTH AND FINENESS

FIELD OF THE INVENTION

The present invention relates to a novel cotton fabric having an excellent hand such as suppleness and flexibility. More particularly, it relates to a novel silk-like woven cotton fabric having smoothness and softness, a novel soft-touch woven cotton fabric having suppleness and gloss, a novel woven cotton fabric having suppleness as well as excellent gloss and warmth retaining properties, a novel knit cotton fabric having excellent flexibility and gloss, and a novel knit cotton fabric having suppleness as well as excellent bulkiness and gloss.

BACKGROUND OF THE INVENTION

The quality of fiber articles has a tendency to shift from the conventional properties such as durability to sensible properties giving a comfortable feeling. Even in the case of woven cotton fabrics, those having a silk-like texture have been developed and studied in association with the tendency toward sensibility. As an example for this purpose, there has been developed a woven fabric made of a spun yarn of small count which is prepared from high-quality raw cotton having a great fiber length and a small fineness.

The fiber length and fineness of conventional raw cotton will, however, vary depending upon its kind and other factors, and when raw cotton having a small fiber length is used, it is difficult to prepare a spun yarn of small count. Even in the case of Sea island cotton which is said to have a great fiber length and a small fineness, the quality of woven fabrics obtained therefrom is not yet sufficient and unsatisfactory.

SUMMARY OF THE INVENTION

Under these circumstances, the present inventors have intensively studied to develop a cotton fabric having an excellent hand. As the result, they have found that such a cotton fabric can be obtained frown a spun yarn of particular English count comprising cotton fibers having a great fiber length and a small fineness, thereby completing the present invention.

Thus, the present invention provides a novel cotton fabric having an excellent hand such as suppleness and flexibility, which is made of a spun yarn of 5's to 250's English count comprising cotton fibers, each of which has an effective fiber length of at least 1.8 inches and a micronaire fineness of at most 3.8 μg/inch, characterized in that the average of bending rigidity values (B) in the warp or wale direction and the weft or course direction of said fabric as measured by a KES-FB2 tester is in the range of 0.002 to 0.100 gf.cm$^2$/cm, and the average of shear stiffness values (G) in the warp or wale direction and the weft or course direction of said fabric as measured by a KES-FB1 tester is in the range of 0.2 to 1.70 gf/cm.degree.

In a preferred embodiment, the above-described cotton fabric is a novel silk-like woven fabric having smoothness, softness and drape properties. The woven cotton fabric has a cover factor of 20 to 50 and is made of a spun yarn of 100's to 250's English count comprising cotton fibers, each of which has an effective fiber length of at least 1.8 inches and a micronaire fineness of at most 3.8 μg/inch, the average of bending rigidity values (B) in the warp and weft directions of said fabric as measured by a KES-FB2 tester being in the range of 0.015 to 0.040 gf.cm$^2$/cm, the average of shear stiffness values (G) in the warp and weft directions of said fabric as measured by a KES-FB1 tester being in the range of 0.50 to 1.00 gf/cm.degree, the average of mean values of the coefficient of friction (MIU) in the warp and weft directions of said fabric as measured by a KES-FB4 tester being in the range of 0.1 to 0.3, and the average of mean deviations of surface roughness (SMD) in the warp and weft directions of said fabric as measured by a KES-FB4 tester being in the range of 1.0 to 2.0 microns.

In another preferred embodiment, the above-described cotton fabric is a novel soft-touch woven fabric having suppleness and gloss. The woven cotton fabric has a cover factor of 12 to 40 and is made of a spun yarn of 60's to 100's English count comprising cotton fibers, each of which has an effective fiber length of at least 1.8 inches and a micronaire fineness of at most 3.8 μg/inch, the average of bending rigidity values (B) in the warp and weft directions of said fabric as measured by a KES-FB2 tester being in the range of 0.025 to 0.070 gf.cm$^2$/cm, the average of shear stiffness values (G) in the warp and weft directions of said fabric as measured by a KES-FB1 tester being in the range of 1.00 to 1.50 gf/cm.degree, and the gloss value of said fabric as measured by the Jeffrie's method using an automatic goniophotometer being in the range of 0.6 to 1.2.

In another preferred embodiment, the above-described cotton fabric is a novel woven fabric having soft and supple hands as well as excellent gloss and warmth retaining properties. The woven cotton fabric has a cover factor of 5 to 30 and is made of a spun yarn of 10's to 60's English count comprising cotton fibers, each of which has an effective fiber length of at least 1.8 inches and a micronaire fineness of at most 3.8 μg/inch, the average of bending rigidity values (B) in the warp and weft directions of said fabric as measured by a KES-FB2 tester being in the range of 0.055 to 0.100 gf.cm$^2$/cm, the average of shear stiffness value (G) in the warp and weft directions of said fabric as measured by a KES-FB1 tester being in the range of 1.10 to 1.70 gf/cm.degree, the gloss value of said fabric as measured by the Jeffrie's method using an automatic goniophotometer being in the range of 0.7 to 1.5, and the warmth retaining factor of said fabric as measured by the warmth retaining test procedure of JIS L-1096 (isothermal method) being in the range of 10.0 to 13.0.

In another preferred embodiment, the above-described cotton fabric is a novel knit fabric having excellent flexibility and gloss. The knit cotton fabric is made of a spun yarn of 40's to 250's English count comprising cotton fibers, each of which has an effective fiber length of at least 1.8 inches and a micronaire fineness of at most 3.8 μg/inch, the average of bending rigidity values (B) in the wale and course directions of said fabric as measured by a KES-FB2 tester being in the range of 0.002 to 0.050 gf.cm$^2$/cm, the average of shear stiffness values (G) in the wale and course directions of said fabric as measured by a KES-FB1 tester being in the range of 0.30 to 1.20 gf/cm.degree, and the gloss value of said fabric as measured by the Jeffrie's method using an automatic goniophotometer being in the range of 0.6 to 1.2.

In another preferred embodiment, the above-described cotton fabric is a novel knit fabric having suppleness as well as excellent bulkiness and gloss. The knit cotton fabric is made of a spun yarn of 5's to 40's English count comprising cotton fibers, each of which has an effective fiber length of at least 1.8 inches and a micronaire fineness of at most 3.8 μg/inch, the average of bending rigidity values (B) in the wale and course directions of said fabric as measured by a KES-FB2 tester being in the range of 0.005 to 0.100 gf.cm$^2$/cm, the average of shear stiffness values (G) in the wale and course directions of said fabric as measured by a KES-FB1 tester being in the range of 0.2 to 1.1 gf/cm.degree, the percent vacancy (EMC) of said fabric as measured by a KES-FB3 tester being in the range of 30% to 50%, and the gloss value of said fabric as measured by the Jeffrie's method using an automatic goniophotometer being in the range of 0.8 to 1.6.

DETAILED DESCRIPTION OF THE INVENTION

The cotton fabric of the present invention is made of a spun yarn of 5's to 250's English count. In particular, a spun yarn of 100's to 250's English count is preferred for the production of a silk-like woven fabric having smoothness, softness and drape properties; a spun yarn of 60's to 100's English count is preferred for the production of a soft-touch woven fabric having suppleness and gloss; a spun yarn of 10's to 60's English count is preferred for the production of a woven fabric having soft and supple hands as well as excellent gloss and warmth retaining properties; a spun yarn of 40's to 250's English count is preferred for the production of a knit fabric having excellent flexibility and gloss; and a spun yarn of 5' to 40's English count is preferred for the production of a knit fabric having suppleness as well as excellent bulkiness and gloss. In this way, the English count of a spun yarn to be used in the present invention is determined in the above range according to the desired hands of cotton fabrics.

As used herein, the term "hand" or "hands" refers to the overall characteristics obtained by evaluating a cotton fabric for texture, flexibility and other properties with a feel, unless otherwise indicated.

The spun yarn can be prepared by drawing cotton fibers from raw cotton having a great fiber length, such as Sea Island cotton having an average fiber length of 1.6 inches and an average micronaire fineness of 3.8 μg/inch, and then collecting the fraction of cotton fibers having a great fiber length, followed by ordinary spinning. The resulting spun yarn contains raw cotton fibers in an amount of at least 20% by weight, preferably at least 30% by weight, more preferably at least 35% by weight, and most preferably 100% by weight, based on the total weight of the spun yarn.

The effective fiber length of cotton fibers is at least 1.8 inches, and although it has no particular upper limit so long as the cotton fibers can be prepared, it is preferably in the range of 2.0 to 2.5 inches. The micronaire fineness of cotton fibers is at most 3.8 μg/inch, and although it has no particular lower limit so long as the cotton fibers can be prepared, it is preferably in the range of 3.2 to 3.5 μg/inch. When the effective fiber length is less than 1.8 inches, the following disadvantages will be encountered. The operating characteristics in the production of a spun yarn of smaller count such as 40's to 250's English count are markedly deteriorated. In the case of a spun yarn of 5's to 100's English count, the spun yarn has an increased number of fiber ends, at which a great amount of down is formed, so that the number of twist cannot be reduced in the production of a spun yarn and the fabric obtained will lose its gloss, thereby making it impossible to obtain a woven or knit cotton fabric having preferred gloss.

Figure 1:
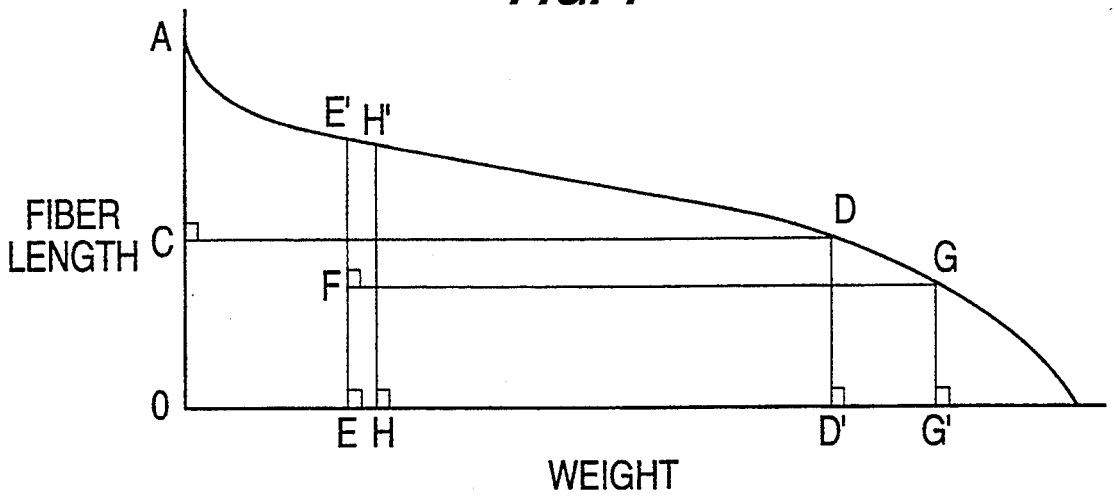
FIG. 1 is a staple diagram showing how to determine an effective fiber length.

The effective fiber length is determined as follows. The fibers are placed in order of length and a staple diagram is depicted as shown in FIG. 1. First of all, point C is taken in the middle of segment OA corresponding to the greatest fiber length (i.e., $OC=\frac{1}{2}OA$). A line is drawn from point C to the curve in parallel with the horizontal axis, the point of which intersection is named D, and a perpendicular line is drawn from point D to the horizontal axis, the point of which intersection is named D'. Point E is taken on the horizontal axis in such a manner that the length of segment OE is a quarter the length of segment OD' (i.e., $OE=\frac{1}{4}OD'$). A perpendicular line is drawn from point E to the curve, the point of which intersection is named E', and point F is taken in the middle of segment EE' (i.e., $EF=\frac{1}{2}EE'$). In the same manner as described above for points D' and E, points G' and H are obtained (i.e., $OH=\frac{1}{4}OG'$). A perpendicular line is drawn from point H to the curve, the point of which intersection is named H', and the length of segment HH' is defined as the effective fiber length.

When the micronaire fineness is more than 3.8, the following disadvantages will be encountered. The production of a spun yarn of smaller count such as 100's to 250's English count becomes difficult because the number of fibers contained in such a spun yarn is reduced. In the case of a spun yarn of 10's to 100's English count, cotton fibers become difficult to bend, so that the fabric obtained will lose its softness and suppleness, which is not preferred. In particular, the vacancy of a spun yarn of 10's to 60's English count is reduced because of its decreased number of fibers contained therein, so that the warmth retaining properties of the fabric obtained will be deteriorated. In the case of a spun yarn of high count such as 5' to 10's English count, the bending rigidity of fibers becomes large, which is not preferred. Thus, as described above, in the present invention using a spun yarn of 5' to 250' English count, it is preferred to use cotton fibers having a micronaire fineness of at most 3.8 μg/inch.

The micronaire fineness is determined by the micronaire method which is well known in the art. This fineness is defined as the weight of a fiber per inch, expressed in 1/1000 mg, i.e. in μg/inch.

The twist coefficient of a spun yarn, although it may vary depending upon the customer's demand for soft twist yarns or hard twist yarns, is preferably in the range of 3.0 to 4.0, which is in inch mode. In general, the twist coefficient K is obtained by the relationship: $T=K\sqrt{N_e}$ wherein T is the number of twists (times/inch) and $N_e$ is the English count of the spun yarn.

As the method of drawing cotton fibers from raw cotton and then collecting the fraction of cotton fibers having a great fiber length, there may be used either method in which cotton fibers having a constant fiber length are drawn from raw cotton and collected with person's hands or in which raw cotton is allowed to pass through a carding machine and cotton fibers having a small fiber length are removed in the combing step. The production of a spun yarn can be carried out in any process, so long as a carding machine, a combing machine, a drawing frame, a flyer frame, a spinning frame and other equipments ordinary used for the production of conventional cotton yarns, are arranged therein.

The cotton fabric of the present invention basically has the following characteristics: the average of bending rigidity values (B) in the warp or wale direction and the weft or course direction of the fabric as measured by a KES-FB2 tester is in the range of 0.002 to 0.100 gf.cm²/cm; and the average of shear stiffness values (G) in the warp or wale direction and the weft or course direction of the fabric as measured by a KES-FB1 tester is in the range of 0.2 to 1.70 gf/cm.degree. These characteristics should be required for attaining the physical properties of the cotton fabric, such as suppleness and softness.

The following will describe a preferred cotton fabric of the present invention, which is a novel silk-like woven cotton fabric having smoothness, softness and drape properties.

The preferred cotton fabric is a woven cotton fabric having a cover factor of 20 to 50, preferably 25 to 40. When the cover factor is less than 20, the woven cotton fabric obtained will have a limp or sleazy hand, which is not a silk-like fabric. When the cover factor is more than 50, the woven cotton fabric obtained will have a stiff or crispy hand, which is not preferred as a silk-like fabric.

The average of bending rigidity values (B) in the warp and weft directions of the fabric as measured by a KES-FB2 tester is in the range of 0.015 to 0.040 gf.cm²/cm, preferably 0.020 to 0.035 gf.cm²/cm. When the average is less than 0.015 gf.cm²/cm, the woven cotton fabric obtained will have a limp hand, which is not a silk-like fabric. When the average is more than 0.040 gf.cm²/cm, the woven cotton fabric obtained will have a stiff hand, which is not preferred as a silk-like fabric.

The average of shear stiffness values (G) in the warp and weft directions of the fabric as measured by a KES-FB1 tester is in the range of 0.50 to 1.00 gf/cm.degree, preferably 0.60 to 0.90 gf/cm.degree. When the average is less than 0.50 gf/cm.degree, the woven cotton fabric obtained will have a limp hand, which is not a silk-like fabric. When the average is more than 1.00 gf/cm.degree, the woven cotton fabric obtained will have a stiff hand and no drape properties, which is not preferred as a silk-like fabric.

The average of mean values of the coefficient of friction (MIU) in the warp and weft directions of the fabric as measured by a KES-FB4 tester is in the range of 0.1 to 0.3. When the average is less than 0.1, the woven cotton fabric obtained will have a quite slippery hand, which is not a silk-like fabric. When the average is more than 0.3, the woven cotton fabric obtained will have a coarse hand, which is not preferred as a silk-like fabric.

The average of mean deviations of surface roughness in the warp and weft directions of the fabric as measured by a KES-FB4 tester is in the range of 1.0 to 2.0 microns. When the average is less than 1.0 micron, the woven cotton fabric obtained will have a quite slick hand, which is not a silk-like fabric. When the average is more than 2.0 microns, the woven cotton fabric obtained will have a rustling hand, which is not preferred as a silk-like fabric.

Both in the process of weaving a cotton fabric and in the process of finishing the woven fabric (gray fabric), any equipments may be employed, which are ordinary used for the weaving and finishing of conventional cotton fabrics.

The cover factor (K) as a parameter denoting a crowding density of fibers in the gray woven fabric is represented by Equation (1):

$$\text{Cover factor } (K)=[2n\times(\tfrac{1}{2})a^{-\frac{1}{2}}+S_w\times(\tfrac{1}{2})b^{-\frac{1}{2}}]\times W/S_w+[2n\times(\tfrac{1}{2})b^{-\frac{1}{2}}+S_t\times(\tfrac{1}{2})a^{-\frac{1}{2}}]\times T/S_t \quad (1)$$

wherein n is the number of crossover points in one cycle, $S_t$ is the number of warps in one cycle, $S_w$ is the number of wefts in one cycle, a is the count of warps, b is the count of wefts, T is the density of warps, and W is the density of wefts.

The hands of woven fabrics obtained are evaluated by the measurement of various characteristics relating to their hands using commercially available KES testers.

The characteristics relating to hands of woven fabrics are various. Flexibility and softness are evaluated by measuring the bending rigidity and shear stiffness of the fabric with KES-FB2 and KES-FB1 testers, respectively, under the standard conditions established for the respective testers, and by expressing as the respective averages of the characteristic values in the warp and weft directions.

Figure 2:
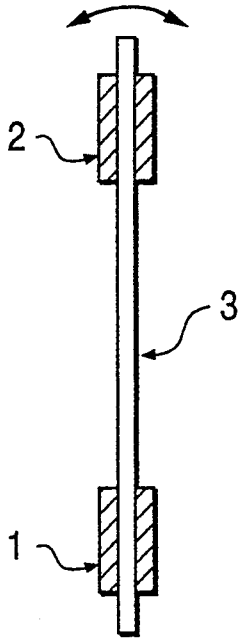
FIG. 2 is a schematic side view showing only a portion including a chuck and a specimen in an apparatus used for the determination of a bending rigidity.
Figure 3:
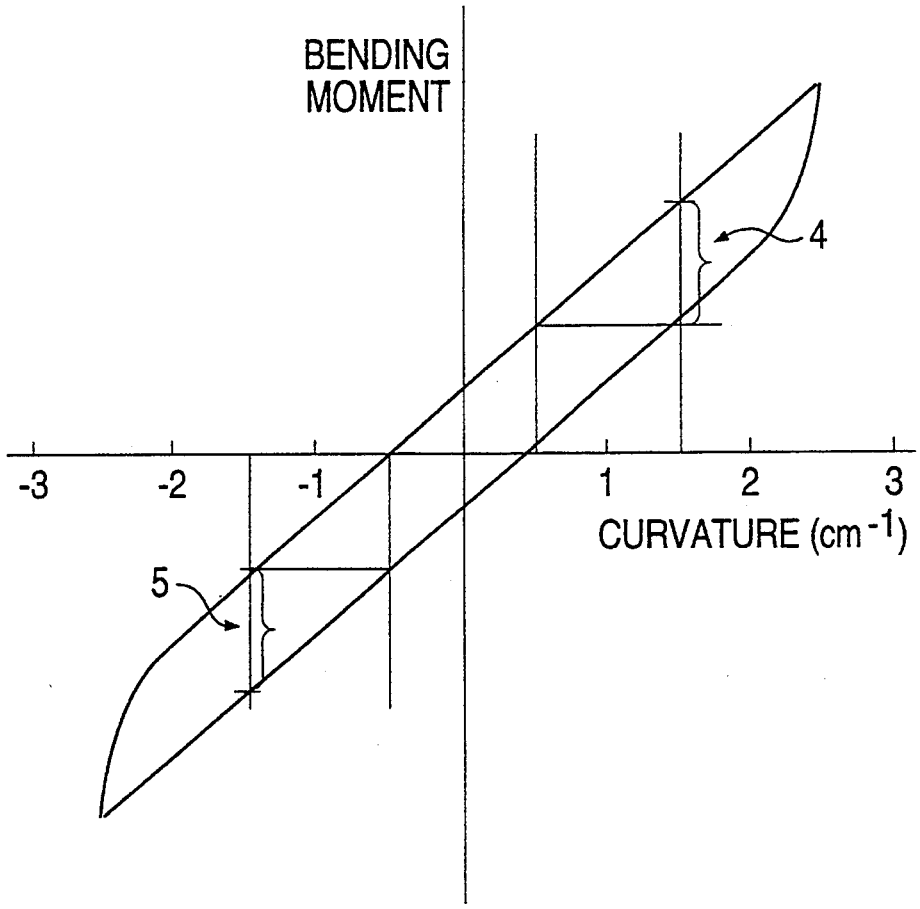
FIG. 3 is a diagram showing a bending moment vs. curvature curve drawn in the determination of a bending rigidity.

The bending rigidity is determined as follows. Specimen 3 is held with chucks 1 and 2 (having a distance of 1 cm) as shown in FIG. 2, and chuck 2 is allowed to move so that the bending curvature of specimen 3 is successively changed from 0 to $+2.5\ cm^{-1}$, from $+2.5$ to $0\ cm^{-1}$, from 0 to $-2.5\ cm^{-1}$, and from $-2.5$ to $0\ cm^{-1}$. Thus, the bending moment vs. curvature curve is obtained as shown in FIG. 3. From this curve, increase 4 of bending moment between the curvatures of $+0.5$ and $+1.5\ cm^{-1}$ during the deformation in bend at the curvatures of 0 to $+2.5\ cm^{-1}$ and increase 5 of bending moment between the curvatures of $-0.5$ to $-1.5\ cm^{-1}$ during the deformation in bend at the curvatures of 0 to $-2.5\ cm^{-1}$ are obtained. The bending rigidity is defined as an average of the absolute values of increases 4 and 5.

Figure 4:
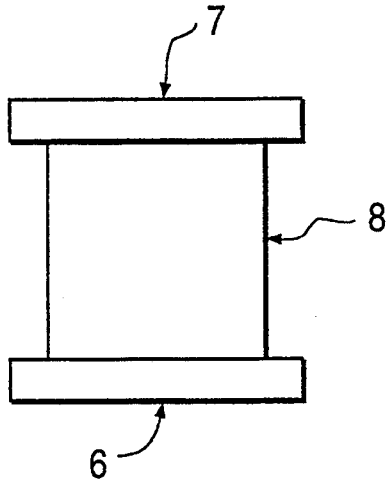
FIG. 4 is a schematic side view showing only a portion including a chuck and a specimen in an apparatus used for the determination of a shear stiffness.
Figure 5:
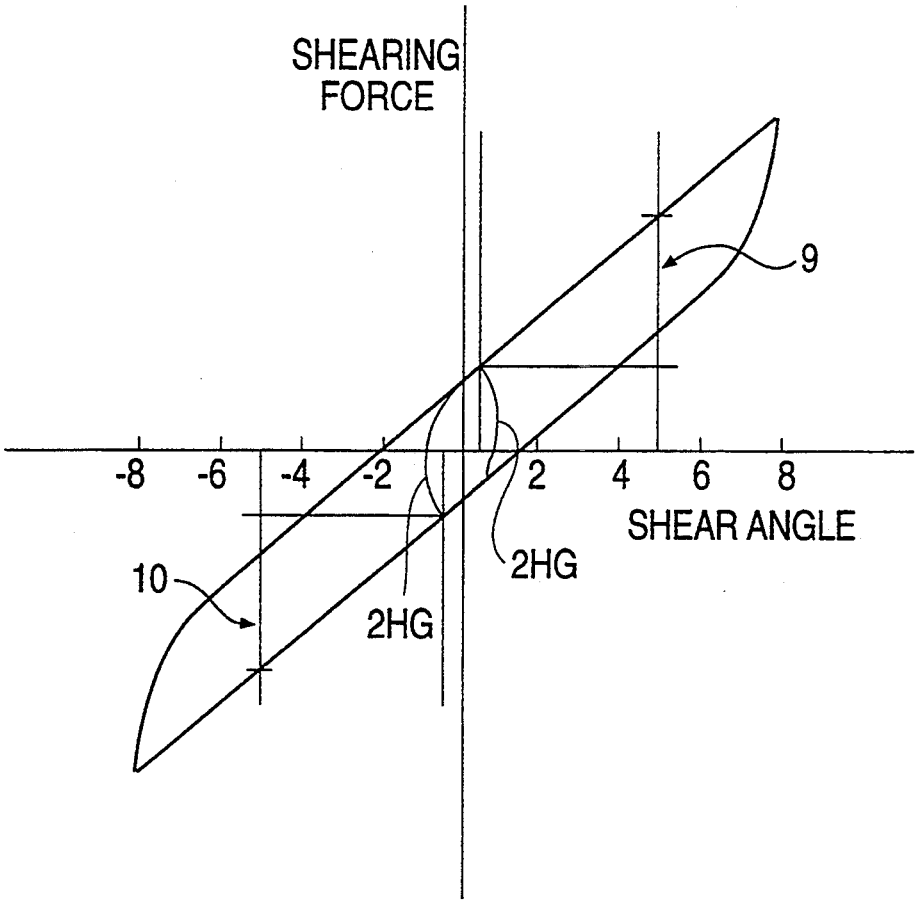
FIG. 5 is a diagram showing a shearing force vs. shear angle curve drawn in the determination of a shear stiffness.

The shear stiffness is determined as follows. Specimen 8 is held with chucks 6 and 7 (having a distance of 5 cm) as shown in FIG. 4, and chuck 7 is allowed to move so that the shear angle of specimen 8 is successively changed from 0° to +8°, from +8° to 0°, from 0° to −8°, and from −8° to 0°. Thus, the shearing force vs. shear angle curve is obtained as shown in FIG. 5. From this curve, increase 9 of shearing force between the shear angles of +0.5° and +5.0° during the shear deformation at the angles of 0° to +8° and increase 10 of shearing force between the shear angles of −0.5° to −5.0° during the shear deformation at the angles of 0° to −8° are obtained. The shear stiffness is defined as an average of the absolute values of increases 9 and 10.

Smoothness is evaluated by measuring the mean value of the coefficient of friction and mean deviation of surface roughness of the fabric with KES-FB4 testers, respectively, under the standard conditions established for the respective testers, and by expressing as the respective averages of the characteristic values in the warp and weft directions.

Figure 6:
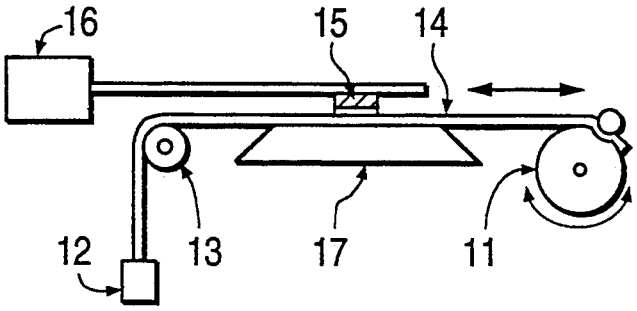
FIG. 6 is a schematic side view showing only a portion including a chuck, a specimen and a friction member in an apparatus for the measurement of a mean value of the coefficient of friction.
Figure 7:
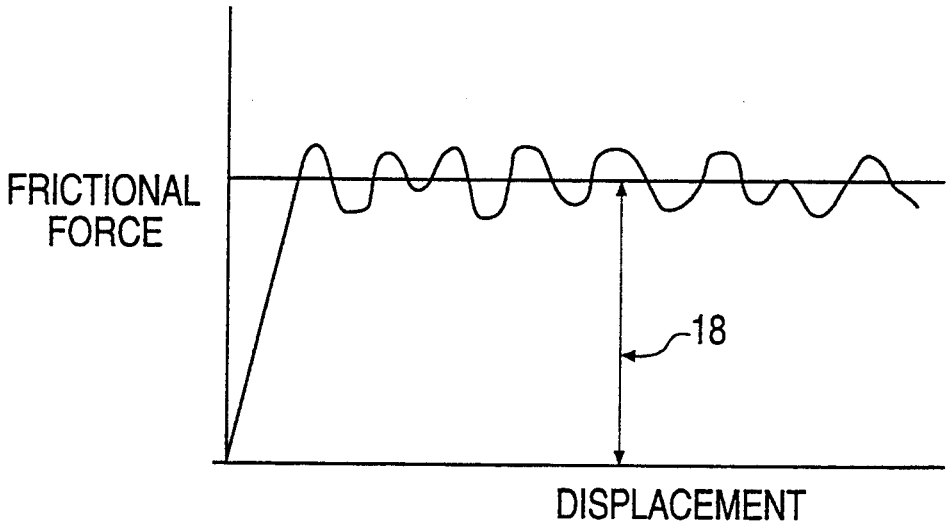
FIG. 7 is a diagram showing a frictional force vs. displacement curve drawn in the determination of a mean value of the coefficient of friction.

The mean value of the coefficient of friction is determined as follows. Specimen 14 is held with chucks 11 and 12 as shown in FIG. 6. Chuck 11 can be rotated so that specimen 14 is allowed to move by the rotation of chuck 11. On specimen 14, friction member 15 is placed, and specimen 14 is allowed to move, at which time the frictional force applied to friction member 15 is measured by force-measuring apparatus 16. Thus, the frictional force vs. displacement curve is obtained as shown in FIG. 7. Mean frictional force 18 obtained from this curve is divided by the weight of friction member 15 to yield the mean value of the coefficient of friction.

Figure 8:
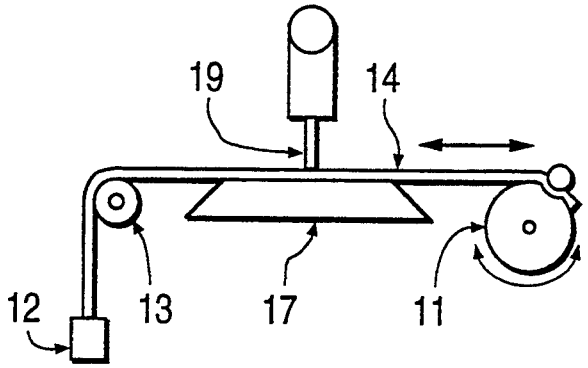
FIG. 8 is a schematic side view showing only a portion including a chuck, a specimen and a contactor in an apparatus for the determination of a mean deviation of surface roughness.
Figure 9:
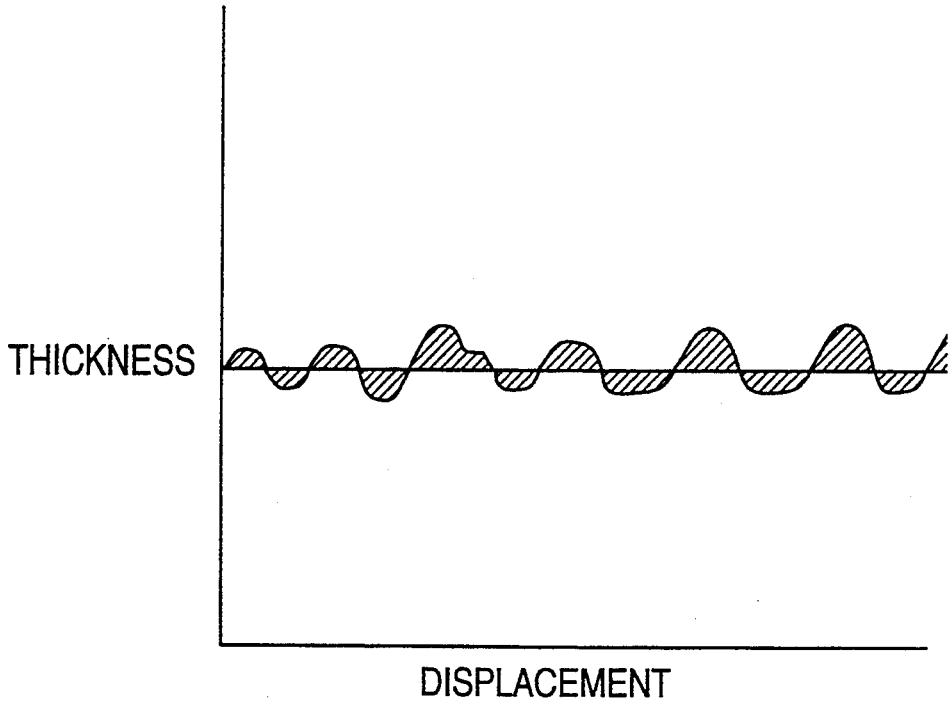
FIG. 9 is a diagram showing a thickness vs. displacement curve drawn in the determination of a mean deviation of surface roughness.

The mean deviation of surface roughness is determined as follows. As shown in FIG. 8, specimen 14 is held with chucks 11 and 12 in the same manner as shown in FIG. 6. On specimen 14, contactor 19 is placed, and specimen 14 is allowed to move on the surface of specimen 14, at which time the thickness of specimen 14 is measured by contactor 19. Thus, a diagram showing the relationship between the thickness of specimen 14 and the displacement of contactor 19 in the direction of movement on the surface of specimen 14 is obtained as shown in FIG. 9. The mean deviation of surface roughness is calculated from the hatched area in this diagram according to the following definition.

$$\text{Mean deviation of surface roughness } (SMD) = \int_0^X |T - T_a|\,dx/X \qquad (2)$$

where T is the thickness of the specimen at position x, $T_a$ is the mean value of the thickness T, x is the displacement of the contactor on the surface of the specimen, and X is the maximum displacement of the contactor taken in the measurement.

The sensuous test relating to the hands of woven fabrics is carded out by preparing a specimen of about 50 cm×50 cm in size with respect to the woven fabric of the present invention and the conventional woven fabric for comparison, and determining the presence of smoothness and softness by a method of paired comparisons while showing the specimens to a specialist in hand decision. The results are represented by O for smoother or softer woven fabrics and X for inferior woven fabrics.

The following will describe another preferred cotton fabric of the present invention, which is a novel soft-touch woven cotton fabric having soft and supple hands as well as gloss.

The preferred cotton fabric is a woven cotton fabric having a cover factor of 12 to 40, preferably 15 to 35, which is obtained by a weaving technique in which a spun yarn of 60's to 100's English count comprising the specific cotton fibers as described above is formed into a single or two folded yarn and used for the warp and weft yarns. When the cover factor is less than 12, the woven cotton fabric obtained will have a limp or sleazy hand, which is not a soft-touch fabric having soft and supple hands. When the cover factor is more than 40, the woven cotton fabric obtained will have a stiff or crispy hand, which is not preferred because the soft and supple hands are lost.

The average of bending rigidity values (B) in the warp and weft directions of the fabric as measured by a KES-FB2 tester is in the range of 0.025 to 0.070 $gf.cm^2/cm$, preferably 0.030 to 0.060 $gf.cm^2/cm$. When the average is less than 0.025 $gf.cm^2/cm$, the woven cotton fabric obtained will have a limp or sleazy hand, which is not a fabric having soft and supple hands requiring resiliency to a certain degree in addition to the flexibility, considering that it is a woven fabric having a cover factor of 12 to 40 obtained from a spun yarn of 60's to 100's English count. When the average is more than 0.070 $gf.cm^2/cm$, the woven cotton fabric obtained will have a stiff hand, which is not preferred because the soft and supple hands are lost.

The average of shear stiffness values (G) in the warp and weft directions of the fabric as measured by a KES-FB1 tester is in the range of 1.00 to 1.50 gf/cm.degree, preferably 1.10 to 1.45 gf/cm.degree. When the average is less than 1.00 gf/cm.degree, the woven cotton fabric obtained will have a limp or sleazy hand, which is not a fabric having soft and supple hands requiring resiliency to a certain degree in addition to the flexibility, considering that it is a woven fabric having a cover factor of 12 to 40 obtained from a spun yarn of 60's to 100's English count. When the average is more than 1.50 gf/cm.degree, the woven cotton fabric obtained will have a stiff or crispy hand and no drape properties, which is not preferred because the soft and supple hands ,are lost.

The gloss value of the fabric as measured by the Jeffrie's method using an automatic goniophotometer is in the range of 0.6 to 1.2, preferably 0.7 to 1.0. When the gloss value is less than 0.6, the woven cotton fabric obtained will lose elegant gloss on the surface thereof, which is not preferred. When the gloss value is more than 1.2, the woven cotton fabric obtained will be glistening because of too much gloss, which is not preferred.

Both in the process of weaving a cotton fabric and in the process of finishing the woven fabric (gray fabric), any equipments may be employed, which are ordinary used for the weaving and finishing of conventional cotton fabrics.

The cover factor (K) as a parameter denoting a crowding density of fibers in the gray woven fabric is represented by Equation (1).

The hands of woven fabrics obtained are evaluated by the measurement of various characteristics relating to their hands using commercially available KES testers.

The characteristics relating to hands of woven fabrics are various. Flexibility and softness are evaluated by measuring the bending rigidity and shear stiffness of the fabric with KES-FB2 and KES-FB1 testers, respectively, under the standard conditions established for the respective testers, and by expressing as the respective averages of the characteristic values in the warp and weft directions.

The bending rigidity is determined as follows. Specimen 3 is held with chucks 1 and 2 (having a distance of 1 cm) as shown in FIG. 2, and chuck 2 is allowed to move so that the bending curvature of specimen 3 is successively changed from 0 to $+2.5\ cm^{-1}$, from $+2.5$ to $0\ cm^{-1}$, from 0 to $-2.5\ cm^{-1}$, and from $-2.5$ to $0\ cm^{-1}$. Thus, the bending moment vs. curvature curve is obtained as shown in FIG. 3. From this curve, increase 4 of bending moment between the curvatures of $+0.5$ and $+1.5\ cm^{-1}$ during the deformation in bend at the curvatures of 0 to $+2.5\ cm^{-1}$ and increase 5 of bending moment between the curvatures of $-0.5$ to $-1.5\ cm^{-1}$ during the deformation in bend at the curvatures of 0 to $-2.5\ cm^{-1}$ are obtained. The bending rigidity is defined as an average of the absolute values of increases 4 and 5.

The shear stiffness is determined as follows. Specimen 8 is held with chucks 6 and 7 (having a distance of 5 cm) as shown in FIG. 4, and chuck 7 is allowed to move so that the shear angle of specimen 8 is successively changed from 0° to +8°, from +8° to 0°, from 0° to −8°, and from −8° to 0°. Thus, the shearing force vs. shear angle curve is obtained as shown in FIG. 5. From this curve, increase 9 of shearing force between the shear angles of +0.5° and +5.0° during the shear deformation at the angles of 0° to +8° and increase 10 of shearing force between the shear angles of −0.5° to −5.0° during the shear deformation at the angles of 0° to −8° are obtained. The shear stiffness is defined as an average of the absolute values of increases 9 and 10.

Figure 10:
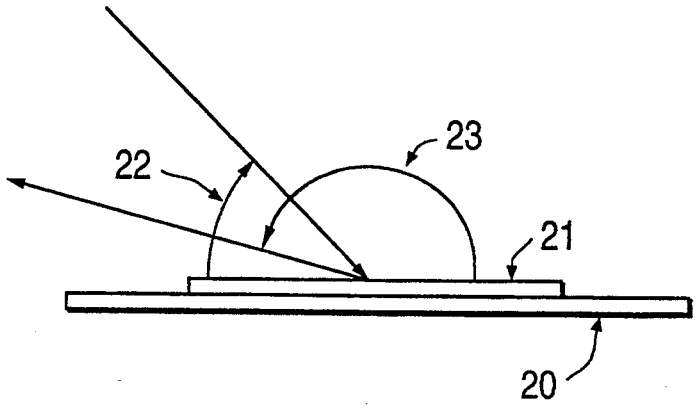
FIG. 10 is a schematic side view showing only a portion including a specimen and also showing the definitions of angles of incidence and reflection of light in the determination of a gloss value by the Jeffrie's method using an automatic goniophotometer.
Figure 11:
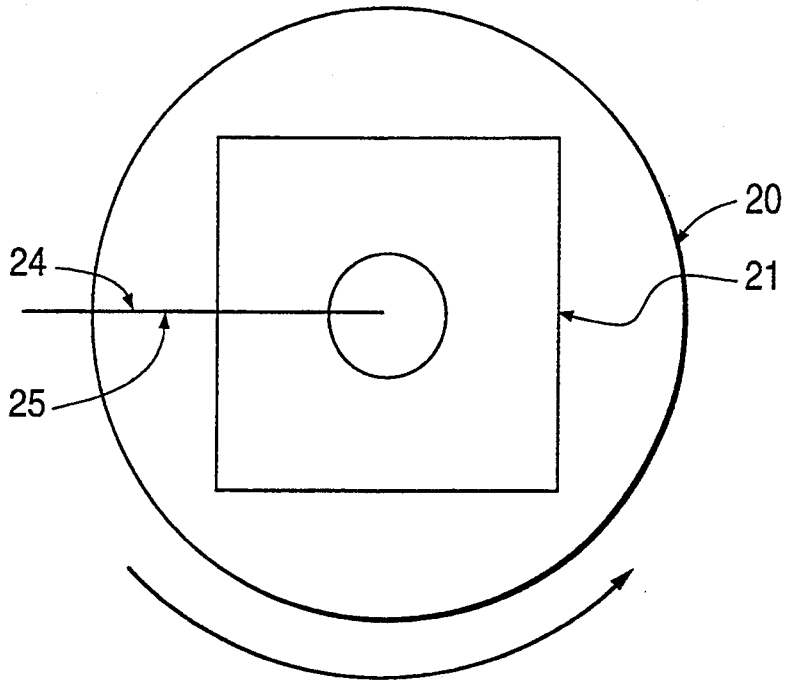
FIG. 11 is a schematic top plan view showing the direction of rotation of the stage in the determination of a gloss value by the Jeffrie's method using an automatic goniophotometer.
Figure 12:
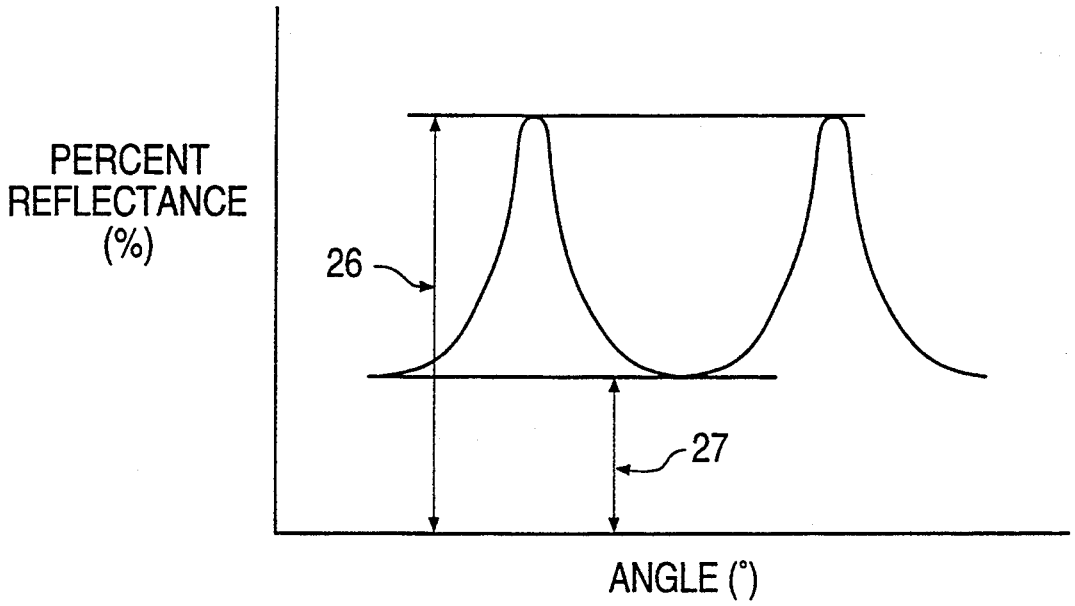
FIG. 12 is a diagram showing a percent reflectance vs. angle curve drawn in the determination of a gloss value by the Jeffrie's method using an automatic goniophotometer.

The gloss value is measured by the Jeffrie's method using an automatic goniophotometer as follows. As shown in FIG. 10, specimen 21 is placed on stage 20. The angle 22 of incidence of light on specimen 21 is set at +43°, and the angle 23 of reflection of light on specimen 21 is set at +165°. Then, specimen 21 is rotated on the surface of stage 20 at 360° in a specific direction indicated by the arrow as shown in FIG. 11. Thus, percent reflectance vs. angle curve is obtained as shown in FIG. 12. From this curve, the ratio of the maximum reflectance 26 to the minimum reflectance 27 is obtained, and the gloss value is defined by this ratio.

The sensuous test relating to the hands of woven fabrics is carded out by preparing a specimen of about 50 cm×50 cm in size with respect to the woven fabric of the present invention and the conventional woven fabric for comparison, and determining the presence of smoothness and softness by a method of paired comparisons while showing the specimens to a specialist in hand decision. The results are represented by O for smoother or softer woven fabrics and X for inferior woven fabrics.

The following will describe another preferred cotton fabric of the present invention, which is a novel woven fabric having soft and supple hands as well as excellent gloss and warmth retaining properties.

The preferred cotton fabric is a woven cotton fabric having a cover factor of 5 to 30, preferably 8 to 25, which is obtained by a weaving technique in which a spun yarn of 10's to 60's English count comprising the specific cotton fibers as described above is formed into a single or two folded yarn and used for the warp and weft yarns. When the cover factor is less than 5, the woven cotton fabric obtained will have a limp or sleazy hand, which is not a fabric having soft and supple hands. When the cover factor is more than 30, the woven cotton fabric obtained will have a stiff or crispy hand, which is not preferred because the soft and supple hands are lost.

The average of bending rigidity values (B) in the warp and weft directions of the fabric as measured by a KES-FB2 tester is in the range of 0.055 to 0.100 $gf.cm^2/cm$, preferably 0.060 to 0.090 $gf.cm^2/cm$. When the average is less than 0.055 $gf.cm^2/cm$, the woven cotton fabric obtained will have a limp or sleazy hand, which is not a fabric having soft and supple hands requiring resiliency to a certain degree in addition to the flexibility, considering that it is a woven fabric having a cover factor of 5 to 30 obtained from a spun yarn of 10's to 60's English count. When the average is more than 0.100 $gf.cm^2/cm$, the woven cotton fabric obtained will have a stiff hand, which is not preferred because the soft and supple hands are lost.

The average of shear stiffness values (G) in the warp and weft directions of the fabric as measured by a KES-FB1 tester is in the range of 1.10 to 1.70 gf/cm.degree, preferably 1.15 to 1.65 gf/cm.degree. When the average is less than 1.10 gf/cm.degree, the woven cotton fabric obtained will have a limp or sleazy hand, which is not a fabric having soft and supple hands requiring resiliency to a certain degree in addition to the flexibility, considering that it is a woven fabric having a cover factor of 5 to 30 obtained from a spun yarn of 10's to 60's English count. When the average is more than 1.70 gf/cm.degree, the woven cotton fabric obtained will have a stiff or crispy hand and no drape properties, which is not preferred because the soft and supple hands are lost.

The gloss value of the fabric as measured by the Jeffrie's method using an automatic goniophotometer is in the range of 0.7 to 1.5, preferably 0.8 to 1.4. When the gloss value is less than 0.7, the woven cotton fabric obtained will lose elegant gloss on the surface thereof, which is not preferred. When the gloss value is more than 1.5, the woven cotton fabric obtained will be glistening because of too much gloss, which is not preferred.

The warmth retaining factor of the fabric as measured by the warmth retaining test procedure of JIS L-1096 (isothermal method) is in the range of 10.0 to 13.0, preferably 10.5 to 12.5. When the warmth retaining factor is less than 10.0, if a woven fabric having a cover factor of 5 to 30 obtained from a spun yarn of 10's to 60's English count is used for cloths, extreme dissipation of the body heat will occur, and therefore, such a woven fabric is not preferred as a cloths material. When the warmth retaining factor is more than 13.0, only slight dissipation of the body heat will occur, and such a woven fabric is not preferred as a cloths material when the cloths are worn in summer.

Both in the process of weaving a cotton fabric and in the process of finishing the woven fabric (gray fabric), any equipments may be employed, which are ordinary used for the weaving and finishing of conventional cotton fabrics.

The cover factor (K) as a parameter denoting a crowding density of fibers in the gray woven fabric is represented by Equation (1).

The hands of woven fabrics obtained are evaluated by the measurement of various characteristics relating to their hands using commercially available KES testers.

The characteristics relating to hands of woven fabrics are various. Flexibility and softness are evaluated by measuring the bending rigidity and shear stiffness of the fabric with KES-FB2 and KES-FB1 testers, respectively, under the standard conditions established for the respective testers, and by expressing as the respective averages of the characteristic values in the warp and weft directions.

The bending rigidity is determined as follows. Specimen 3 is held with chucks 1 and 2 (having a distance of 1 cm) as shown in FIG. 2, and chuck 2 is allowed to move so that the bending curvature of specimen 3 is successively changed from 0 to $+2.5\ cm^{-1}$, from $+2.5$ to $0\ cm^{-1}$, from 0 to $-2.5\ cm^{-1}$, and from $-2.5$ to $0\ cm^{-1}$. Thus, the bending moment vs. curvature curve is obtained as shown in FIG. 3. From this curve, increase 4 of bending moment between the curvatures of $+0.5$ and $+1.5\ cm^{-1}$ during the deformation in bend at the curvatures of 0 to $+2.5\ cm^{-1}$ and increase 5 of bending moment between the curvatures of $-0.5$ to $-1.5\ cm^{-1}$ during the deformation in bend at the curvatures of 0 to $-2.5\ cm^{-1}$ are obtained. The bending rigidity is defined as an average of the absolute values of increases 4 and 5.

The shear stiffness is determined as follows. Specimen 8 is held with chucks 6 and 7 (having a distance of 5 cm) as shown in FIG. 4, and chuck 7 is allowed to move so that the shear angle of specimen 8 is successively changed from 0° to +8°, from +8° to 0°, from 0° to −8°, and from −8° to 0°. Thus, the shearing force vs. shear angle curve is obtained as shown in FIG. 5. From this curve, increase 9 of shearing force between the shear angles of +0.5° and +5.0° during the shear deformation at the angles of 0° to +8° and increase 10 of shearing force between the shear angles of −0.5° to −5.0° during the shear deformation at the angles of 0° to −8° are obtained. The shear stiffness is defined as an average of the absolute values of increases 9 and 10.

The gloss value is measured by the Jeffrie's method using an automatic goniophotometer as follows. As shown in FIG. 10, specimen 21 is placed on stage 20. The angle 22 of incidence of light on specimen 21 is set at +43°, and the angle 23 of reflection of light on specimen 21 is set at +165°. Then, specimen 21 is rotated on the surface of stage 20 at 360° in a specific direction indicated by the arrow as shown in FIG. 11. Thus, percent reflectance vs. angle curve is obtained as shown in FIG. 12. From this curve, the ratio of the maximum reflectance 26 to the minimum reflectance 27 is obtained, and the gloss value is defined by this ratio.

Figure 13:
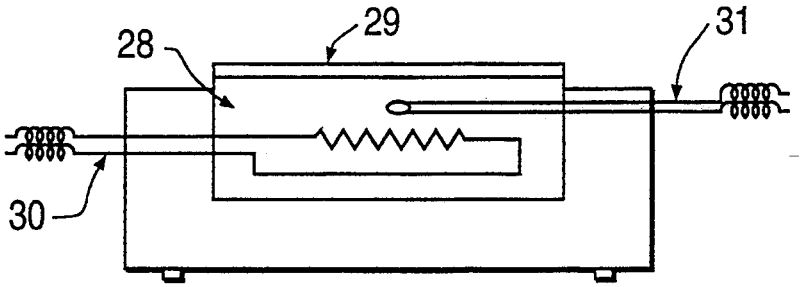
FIG. 13 is a schematic side view showing only a portion including a constant temperature heating element and a specimen in the determination of a warmth retaining factor by the isothermal method using a warmth retaining tester.

The warmth retaining factor is measured by the warmth retaining test procedure of JIS L-1096 (isothermal method) as follows. As shown in FIG. 13, specimen 29 is attached to constant temperature heating medium 28 having the regulated constant temperature. The amount of heat dissipated through specimen 29 is measured for the test period of 2 hours. The amount of heat dissipated when specimen 29 is not attached to constant temperature heating medium 28 is also measured for the test period of 2 hours. The warmth retaining factor is calculated by Equation (3):

$$\text{Warmth retaining factor } (\%) = (1 - b/a) \times 100 \quad (3)$$

where a is the amount of heat dissipated (power consumption) when no specimen is attached to the constant temperature heating element and b is the amount of heat dissipated (power consumption) when a specimen is attached to the constant temperature heating element. The constant temperature heating element 28 has electric heater 30 and thermistor 31 in the inside thereof, and electric heater 30 is connected to an integrating wattmeter. Electric heater 30 and thermistor 31 are connected together in the temperature control part, so that the temperature of the constant temperature heating element 28 is kept constant. The amounts of heat dissipated in the presence or absence of a specimen are evaluated by the respective cumulative power consumptions.

The sensuous test relating to the hands of woven fabrics is carried out by preparing a specimen of about 50 cm×50 cm in size with respect to the woven fabric of the present invention and the conventional woven fabric for comparison, and determine the presence of suppleness, softness, thickness and gloss by a method of paired comparisons while showing the specimens to a specialist in hand decision. The results are represented by O for suppler, softer or thicker woven fabrics and X for inferior woven fabrics.

The following will describe another preferred cotton fabric of the present invention, which is a novel knit fabric having excellent flexibility and gloss.

The preferred cotton fabric is a knit cotton fabric which is obtained by a knitting technique in which a spun yarn of 40's to 250's English count comprising the specific cotton fibers as described above is formed into a single or two folded yarn and used for knitting yarns.

The average of bending rigidity values (B) in the wale and course directions of the fabric as measured by a KES-FB2 tester is in the range of 0.002 to 0.050 $gf.cm^2/cm$, preferably 0.003 to 0.045 $gf.cm^2/cm$. When the average is less than 0.002 $gf.cm^2/cm$, the knit cotton fabric obtained will have a limp or flaccid hand, which is not preferred. When the average is more than 0.050 $gf.cm^2/cm$, the knit cotton fabric obtained will have a stiff or crispy hand, which is not preferred. The wale and course directions as used herein correspond to the warp and weft directions for woven fabrics, respectively.

The average of shear stiffness values (G) in the wale and course directions of the fabric as measured by a KES-FB1 tester is in the range of 0.30 to 1.20 gf/cm.degree, preferably 0.35 to 1.10 gf/cm.degree. When the average is less than 0.35 gf/cm.degree, the knit cotton fabric obtained will have a limp or flimsy hand, which is not preferred. When the average is more than 1.20 gf/cm.degree, the knit cotton fabric obtained will have a stiff hand and no drape properties, which is not preferred.

The gloss value of the fabric as measured by the Jeffrie's method using an automatic goniophotometer is in the range of 0.6 to 1.2, preferably 0.7 to 1.1. When the gloss value is less than 0.6, the knit cotton fabric obtained will lose elegant gloss on the surface thereof, which is not preferred. When the gloss value is more than 1.2, the knit cotton fabric obtained will be glistening because of too much gloss, which is not preferred.

Both in the process of knitting a cotton fabric and in the process of finishing the knit fabric (gray fabric), any equipments may be employed, which are ordinary used for the knitting and finishing of conventional cotton fabrics.

The hands of knit fabrics obtained are evaluated by the measurement of various characteristics relating to their hands using commercially available KES testers.

The characteristics relating to hands of knit fabrics are various. Flexibility and softness are evaluated by measuring the bending rigidity and shear stiffness of the fabric with KES-FB2 and KES-FB1 testers, respectively, under the standard conditions established for the respective testers, and by expressing as the respective averages of the characteristic values in the wale and course directions.

The bending rigidity is determined as follows. Specimen 3 is held with chucks 1 and 2 (having a distance of 1 cm) as shown in FIG. 2, and chuck 2 is allowed to move so that the bending curvature of specimen 3 is successively changed from 0 to $+2.5\ cm^{-1}$, from $+2.5$ to $0\ cm^{-1}$, from 0 to $-2.5\ cm^{-1}$, and from $-2.5$ to $0\ cm^{-1}$. Thus, the bending moment vs. curvature curve is obtained as shown in FIG. 3. From this curve, increase 4 of bending moment between the curvatures of $+0.5$ and $+1.5\ cm^{-1}$ during the deformation in bend at the curvatures of 0 to $+2.5\ cm^{-1}$ and increase 5 of bending moment between the curvatures of $-0.5$ to $-1.5\ cm^{-1}$ during the deformation in bend at the curvatures of 0 to $-2.5\ cm^{-1}$ are obtained. The bending rigidity is defined as an average of the absolute values of increases 4 and 5.

The shear stiffness is determined as follows. Specimen 8 is held with chucks 6 and 7 (having a distance of 5 cm) as shown in FIG. 4, and chuck 7 is allowed to move so that the shear angle of specimen 8 is successively changed from 0° to +8°, from +8° to 0°, from 0° to −8°, and from −8° to 0°. Thus, the shearing force vs. shear angle curve is obtained as shown in FIG. 5. From this curve, increase 9 of shearing force between the shear angles of +0.5° and +5.0° during the shear deformation at the angles of 0° to +8° and increase 10 of shearing force between the shear angles of −0.5° to −5.0° during the shear deformation at the angles of 0° to −8° are obtained. The shear stiffness is defined as an average of the absolute values of increases 9 and 10.

The gloss value is measured by the Jeffrie's method using an automatic goniophotometer as follows. As shown in FIG. 10, specimen 21 is placed on stage 20. The angle 22 of incidence of light on specimen 21 is set at +43°, and the angle 23 of reflection of light on specimen 21 is set at +165°. Then, specimen 21 is rotated on the surface of stage 20 at 360° in a specific direction indicated by the arrow as shown in FIG. 11. Thus, percent reflectance vs. angle curve is obtained as shown in FIG. 12. From this curve, the ratio of the maximum reflectance 26 to the minimum reflectance 27 is obtained, and the gloss value is defined by this ratio.

The sensuous test relating to the hands of knit fabrics is carried out by preparing a specimen of about 50 cm×50 cm in size with respect to the knit fabric of the present invention and the conventional knit fabric for comparison, and determine the presence of flexibility, softness and gloss by a method of paired comparisons while showing the specimens to a specialist in hand decision. The results are represented by O for more flexible, softer or glossier knit fabrics and X for inferior knit fabrics.

The following will describe another preferred cotton fabric of the present invention, which is a novel knit fabric having suppleness as well as excellent bulkiness and gloss.

The preferred cotton fabric is a knit cotton fabric which is obtained by a knitting technique in which a spun yarn of 5's to 40's English count comprising the specific cotton fibers as described above is formed into a single or two folded yarn and used for knitting yarns.

The average of bending rigidity values (B) in the wale and course directions of the fabric as measured by a KES-FB2 tester is in the range of 0.005 to 0.100 $gf.cm^2/cm$, preferably 0.006 to 0.090 $gf.cm^2/cm$. When the average is less than 0.005 $gf.cm^2/cm$, the knit cotton fabric obtained will have a limp or flaccid hand, which is not preferred. When the average is more than 0.100 $gf.cm^2/cm$, the knit cotton fabric obtained will have a stiff or crispy hand, which is not preferred. The wale and course directions as used herein correspond to the warp and weft directions for woven fabrics, respectively.

The average of shear stiffness values (G) in the wale and course directions of the fabric as measured by a KES-FB1 tester is in the range of 0.2 to 1.1 gf/cm.degree, preferably 0.3 to 1.0 gf/cm.degree. When the average is less than 0.3, the knit cotton fabric obtained will have a limp or flimsy hand, which is not preferred. When the average is more than 1.1, the knit cotton fabric obtained will have a stiff hand and no drape properties, which is not preferred.

The percent vacancy (EMC) of the fabric as measured by a KES-FB3 tester is in the range of 30% to 50%, preferably 32% to 47%. When the percent vacancy is less than 30%, the knit cotton fabric obtained will lose its puffy and bulky hands, which is not preferred. When the percent vacancy is more than 50%, the knit cotton fabric obtained will have a fluffy or extremely large bulky hand, which is not preferred.

The gloss value of the fabric as measured by the Jeffrie's method using an automatic goniophotometer is in the range of 0.8 to 1.6, preferably 0.9 to 1.5. When the gloss value is less than 0.8, the knit cotton fabric obtained will lose its elegant gloss on the surface thereof, which is not preferred. When the gloss value is more than 1.6, the knit cotton fabric obtained will be a knit fabric having a glistening or glittering hand because of too much gloss, which is not preferred.

The hands of knit fabrics obtained are evaluated by the measurement of various characteristics relating to their hands using commercially available KES testers.

The characteristics relating to hands of knit fabrics are various. Suppleness is evaluated by measuring the bending rigidity and shear stiffness of the fabric with KES-FB2 and KES-FB1 testers, respectively, under the standard conditions established for the respective testers, and by expressing as the respective averages of the characteristic values in the wale and course directions.

The bending rigidity is determined as follows. Specimen 3 is held with chucks 1 and 2 (having a distance of 1 cm) as shown in FIG. 2, and chuck 2 is allowed to move so that the bending curvature of specimen 3 is successively changed from 0 to $+2.5\ cm^{-1}$, from $+2.5$ to $0\ cm^{-1}$, from 0 to $-2.5\ cm^{-1}$, and from $-2.5$ to $0\ cm^{-1}$. Thus, the bending moment vs. curvature curve is obtained as shown in FIG. 3. From this curve, increase 4 of bending moment between the curvatures of $+0.5$ and $+1.5\ cm^{-1}$ during the deformation in bend at the curvatures of 0 to $+2.5\ cm^{-1}$ and increase 5 of bending moment between the curvatures of $-0.5$ to $-1.5\ cm^{-1}$ during the deformation in bend at the curvatures of 0 to $-2.5\ cm^{-1}$ are obtained. The bending rigidity is defined as an average of the absolute values of increases 4 and 5.

The shear stiffness is determined as follows. Specimen 8 is held with chucks 6 and 7 (having a distance of 5 cm) as shown in FIG. 4, and chuck 7 is allowed to move so that the shear angle of specimen 8 is successively changed from 0° to +8°, from +8° to 0°, from 0° to −8°, and from −8° to 0°. Thus, the shearing force vs. shear angle curve is obtained as shown in FIG. 5. From this curve, increase 9 of shearing force between the shear angles of +0.5° and +5.0° during the shear deformation at the angles of 0° to +8° and increase 10 of shearing force between the shear angles of −0.5° to −5.0° during the shear deformation at the angles of 0° to −8° are obtained. The shear stiffness is defined as an average of the absolute values of increases 9 and 10.

The gloss value is measured by the Jeffrie's method using an automatic goniophotometer as follows. As shown in FIG. 10, specimen 21 is placed on stage 20. The angle 22 of incidence of light on specimen 21 is set at +43°, and the angle 23 of reflection of light on specimen 21 is set at +165°. Then, specimen 21 is rotated on the surface of stage 20 at 360° in a specific direction indicated by the arrow as shown in FIG. 11. Thus, percent reflectance vs. angle curve is obtained as shown in FIG. 12. From this curve, the ratio of the maximum reflectance 26 to the minimum reflectance 27 is obtained, and the gloss value is defined by this ratio.

The bulkiness is determined by measuring the percent vacancy with a KES-FB3 tester under the standard conditions established for this tester.

Figure 14:
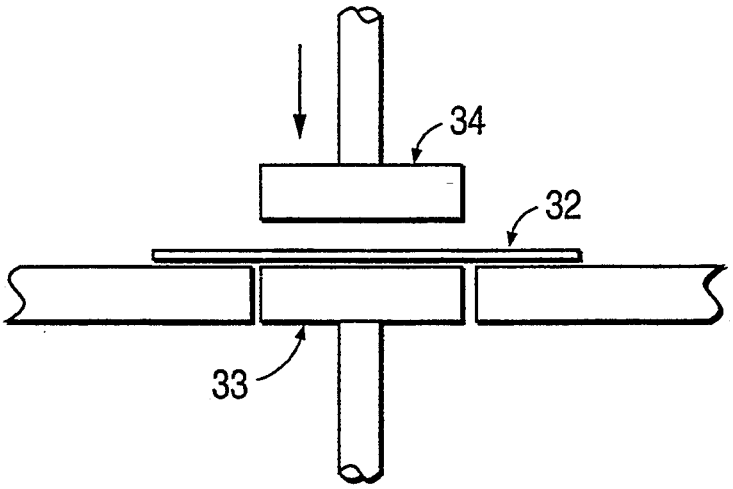
FIG. 14 is a schematic side view showing a specimen in the determination of a percent vacancy.
Figure 15:
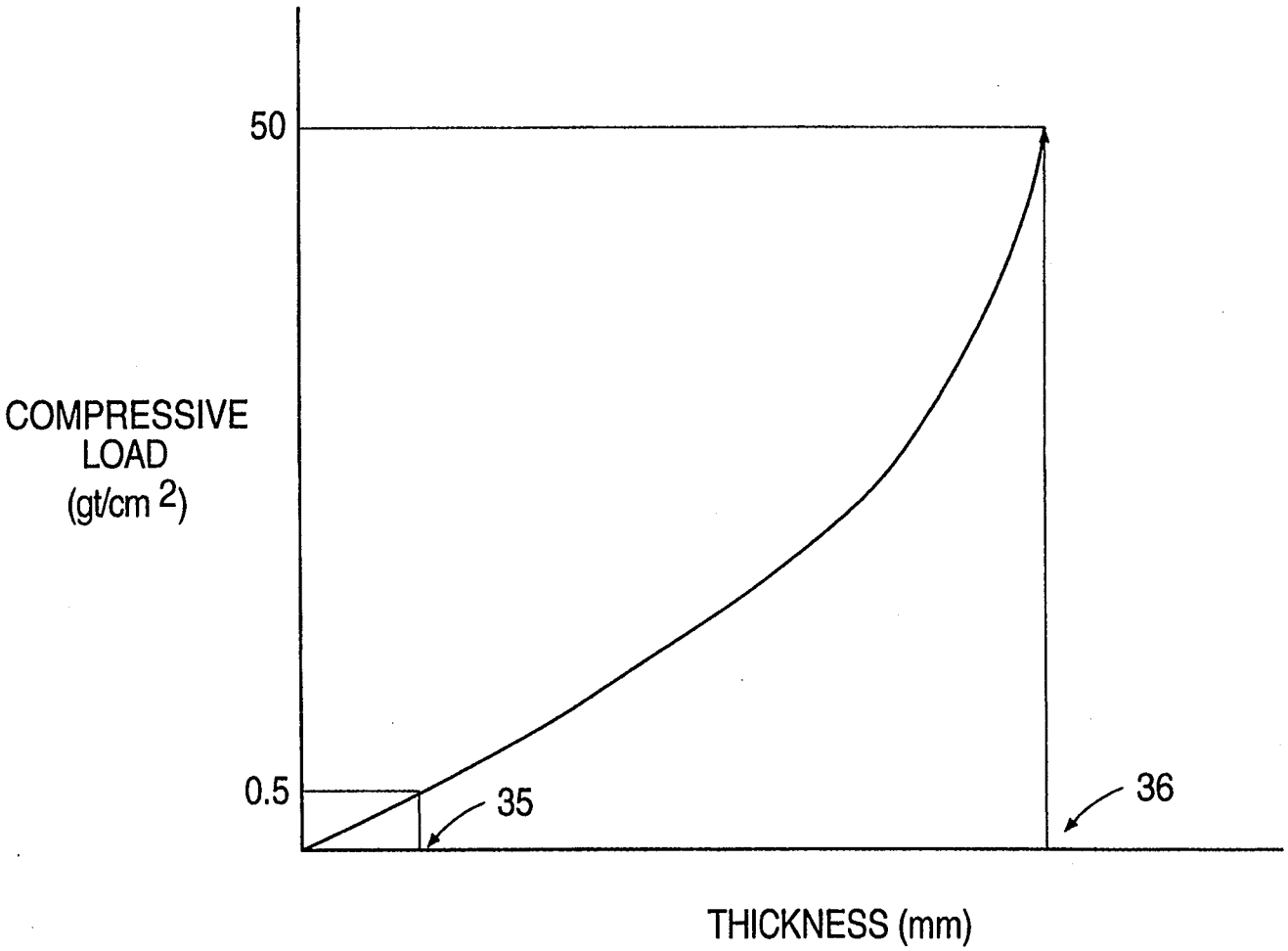
FIG. 15 is a diagram showing a compressive load vs. thickness curve drawn in the determination of a percent vacancy.

The percent vacancy is determined as follows. As shown in FIG. 14, specimen 32 is placed on support 33 directly connected to a force-measuring apparatus. Above support 33, there is disposed compression member 34, the distance of which movement can be measured by a potentiometer. This compression member 34 is allowed to fall gradually, so that compression deformation is applied to specimen 32. Thus, compressive load vs. thickness curve is obtained as shown in FIG. 15. The thickness 35 at a compressive load of 0.5 $gf/cm^2$ and the thickness 36 at a compressive load of 50 $gf/cm^2$ are obtained. The percent vacancy is calculated by Equation (4):

$$\text{Percent vacancy } (\%) = [(a-b)\times 1/a]\times 100 \quad (4)$$

where a is the thickness at a compressive load of 0.5 $gf/cm^2$ and b is the thickness at a compressive load of 50 $gf/cm^2$.

The sensuous test relating to the hands of knit fabrics is carried out by preparing a specimen of about 50 cm×50 cm in size with respect to the knit fabric of the present invention and the conventional knit fabric for comparison, and determine the presence of suppleness, bulkiness and gloss by a method of paired comparisons while showing the specimens to a specialist in hand decision. The results are represented by O for suppler, bulkier or glossier knit fabrics and X for inferior knit fabrics.

EXAMPLES

The present invention will be further illustrated by way of the following examples and comparative examples, which are not to be construed to limit the scope thereof.

Example 1

A mass of Sea Island cotton was broken into small pieces by opening, and allowed to pass through a flat carding machine to form a sliver, which was then supplied to a combing machine adjusted so as to leave only longer fibers, thereby obtaining a sliver made of cotton fibers each having a great fiber length. The sliver thus obtained was successively supplied to a drawing frame and a flyer frame to form a roving having a fineness equivalent to 5's count. The roving was then subjected to drafting at a ratio of about 40 times in a spinning frame, and given a primary twist of 57 times per inch to form a single yarn having a fineness equivalent to 200's count. Further, the single yarn was given a finishing twist of 50 times per inch to form a two folded yarn.

The fiber length of cotton fibers in the sliver after passing through the combing machine was in the range of 1.8 to 2.0 inches as measured by a sorter, and the effective fiber length was 1.92 inches. The cotton fibers had a micronaire fineness of 3.4 μg/inch.

The weaving was carried out as follows. The two folded yarn as described above was provided as 11,100 end warp yarns, and then subjected to win-ping, followed by the weaving of a plain weave fabric as a gray fabric using a loom (Toyada Automatic Loom Works, Ltd.). The gray fabric was bleached with a solution of hydrogen peroxide, and then subjected to conventional mercerization and treatment with a finishing agent such as a softener, thereby obtaining a finished woven fabric.

The woven fabric thus obtained was cut into three specimens each having a size of 20 cm×20 cm, and evaluated by KES testers for various characteristics relating to the hands of woven fabrics, such as weight per unit area, tensile properties, bending properties, shearing properties, thickness/compression properties and surface properties.

The weight per unit area was determined by weighing the specimens and expressed in $gf/m^2$. The tensile properties and thickness/compression properties were determined by the standard methods of measurements using KES testers.

The results are shown in Table 1. The woven fabric of this example had a cover factor (K) of 35.3, which was calculated by Equation (1), where $n=1$, $S_t=2$ and $S_w=2$.

Comparative Example 1

A mass of Sea Island cotton was allowed to pass through a flat carding machine to form a sliver, which was then supplied to a combing machine adjusted to ordinary conditions, thereby obtaining a sliver made of cotton fibers each having a great fiber length. The sliver thus obtained was successively supplied to a drawing frame and a flyer frame to form a roving having a fineness equivalent to 5's count. The roving was then subjected to drafting at a ratio of about 40 times in a spinning frame, and given a primary twist of 57 times per inch to form a single yarn having a fineness equivalent to 200's count. Further, the single yarn was given a finishing twist of 50 times per inch to form a two folded yarn of 200's count, from which a plain weave fabric was produced in the same manner as described in Example 1. The fiber length of Sea Island cotton fibers was ranging from the minimum fiber length of 1.1 inches to the maximum fiber length of 2.0 inches as measured by a sorter, and the effective fiber length was 1.6 inches. The cotton fibers had a micronaire fineness of 3.6 μg/inch.

The woven fabric thus obtained was evaluated for various characteristics in the same manner as described in Example 1. The results are shown in Table 1. The woven fabric of this comparative example had a cover factor (K) of 35.3, which was calculated by Equation (1), where $n=1$, $S_t=2$ and $S_w=2$.

TABLE 1

| Characteristics | Unit | Example 1 | Comp. Ex. 1 |
|---|---|---|---|
| Effective fiber length | inch | 1.92 | 1.60 |
| Micronaire fineness | μg/inch | 3.4 | 3.6 |
| English count (warp) | 'S | 200/2 | 200/2 |
| English count (weft) | 'S | 200/2 | 200/2 |
| Number of threads per unit length (warp) | ends/inch | 235 | 236 |
| Number of threads per unit length (weft) | picks/inch | 118 | 117 |
| Cover factor | | 35.3 | 35.3 |
| Tensile elongation (warp) | % | 6.9 | 6.4 |
| Tensile elongation (weft) | % | 4.8 | 4.4 |
| Average | % | 5.85 | 5.4 |
| Tensile resilience (warp) | % | 57.8 | 56.6 |
| Tensile resilience (weft) | % | 48.3 | 47.6 |
| Average | % | 53.05 | 52.1 |
| Bending rigidity (warp) | gf · cm²/cm | 0.030 | 0.035 |
| Bending rigidity (weft) | gf · cm²/cm | 0.019 | 0.023 |
| Average | gf · cm²/cm | 0.0245 | 0.029 |
| Bending hysteresis (warp) | gf · cm/cm | 0.017 | 0.020 |
| Bending hysteresis (weft) | gf · cm/cm | 0.014 | 0.017 |
| Average | gf · cm/cm | 0.0155 | 0.0185 |
| Shear stiffness (warp) | gf/cm · deg | 0.67 | 0.74 |
| Shear stiffness (weft) | gf/cm · deg | 0.62 | 0.68 |
| Average | gf/cm · deg | 0.645 | 0.71 |
| Shear hysteresis (warp) | gf/cm | 0.56 | 0.61 |
| Shear hysteresis (weft) | gf/cm | 0.38 | 0.42 |
| Average | gf/cm | 0.47 | 0.515 |
| Mean value of the coefficient of friction (warp) | — | 0.090 | 0.098 |
| Mean value of the coefficient of friction (weft) | — | 0.115 | 0.122 |
| Average | — | 0.1025 | 0.11 |
| Mean deviation of surface roughness (warp) | micron | 1.42 | 1.54 |
| Mean deviation of surface roughness (weft) | micron | 0.94 | 0.97 |
| Average | micron | 1.18 | 1.255 |
| Thickness | mm | 0.249 | 0.257 |
| Weight per unit area | gf/m² | 86 | 88 |
| Sensuous test | | | |
| Softness | | ○ | X |
| Smoothness | | ○ | X |

As compared with the conventional woven fabric made of a spun yarn of higher cotton count according to Comparative Example 1, which was produced from raw cotton (Sea Island cotton), the woven fabric according to Example 1 had a smooth surface (i.e., smoothness), slipperiness (i.e., smaller MIU and SMD in the characteristics of woven fabrics), softness (i.e., capable of bending softly), suppleness and drape properties (i.e., smaller B, G and 2HG; see FIG. 5), and it also exhibited supple and soft hands in the sensuous test.

Example 2

A mass of Sea island cotton was broken into small pieces by opening, and allowed to pass through a flat carding machine to form a sliver, which was then supplied to a combing machine adjusted so as to leave only longer fibers, thereby obtaining a sliver made of cotton fibers each having a great fiber length. Separately, polyester staple fibers each having a size of 0.7 denier×51 mm were supplied to a flat carding machine to form a sliver, which was then supplied to a drawing frame for preparing a sliver made of raw cotton fibers and polyester staple fibers in admixture at a weight ratio of 50:50. In the same manner as described in Example 1, two single yarns of 200's count each were combined together to form a two folded yarn.

From this polyester-cotton blended yarn, a woven fabric was produced in the same manner as described in Example 1, except that the gray fabric was breached with a solution of sodium hypochlorite.

The woven fabric thus obtained was evaluated for various characteristics. The results are shown in Table 2. The woven fabric of this example had a cover factor (K) of 35.3, which was calculated by Equation (1), where $n=1$, $S_t=2$ and $S_w=2$.

Comparative Example 2

A mass of Sea Island cotton was broken into small pieces by opening, and allowed to pass through a flat carding machine to form a ribbon lap, which was then supplied to a combing machine adjusted so as to leave only longer fibers, thereby obtaining a sliver made of cotton fibers each having a great fiber length. Separately, polyester staple fibers each having a size of 0.7 denier×51 mm were supplied to a flat carding machine to form a sliver, which was then supplied to a drawing frame for preparing a sliver made of raw cotton fibers and polyester staple fibers in admixture at a weight ratio of 50:50. In the same manner as described in Example 2, a polyester-cotton blended yarn was prepared, from which a woven fabric was produced.

The woven fabric thus obtained was evaluated for various characteristics. The results are shown in Table 2. The woven fabric of this example had a cover factor (K) of 35.3, which was calculated by Equation (1), where $n=1$, $S_t=2$ and $S_w=2$.

TABLE 2

| Characteristics | Unit | Example 2 | Comp. Ex. 2 |
|---|---|---|---|
| Effective fiber length | inch | 1.92 | 1.60 |
| Micronaire fineness | μg/inch | 3.4 | 3.6 |
| English count (warp) | 'S | 200/2 | 200/2 |
| English count (weft) | 'S | 200/2 | 200/2 |
| Number of threads per unit length (warp) | ends/inch | 235 | 236 |
| Number of threads per unit length (weft) | picks/inch | 118 | 117 |
| Cover Factor | | 35.3 | 35.3 |
| Tensile elongation (warp) | % | 5.7 | 5.2 |

TABLE 2-continued

| Characteristics | Unit | Example 2 | Comp. Ex. 2 |
|---|---|---|---|
| Tensile elongation (weft) | % | 4.5 | 4.1 |
| Average | % | 5.1 | 4.65 |
| Tensile resilience (warp) | % | 58.5 | 57.8 |
| Tensile resilience (weft) | % | 49.6 | 48.9 |
| Average | % | 54.05 | 53.35 |
| Bending rigidity (warp) | gf · cm²/cm | 0.031 | 0.033 |
| Bending rigidity (weft) | gf · cm²/cm | 0.017 | 0.021 |
| Average | gf · cm²/cm | 0.024 | 0.027 |
| Bending hysteresis (warp) | gf · cm/cm | 0.020 | 0.025 |
| Bending hysteresis (weft) | gf · cm/cm | 0.018 | 0.022 |
| Average | gf · cm/cm | 0.019 | 0.0235 |
| Shear stiffness (warp) | gf/cm · deg | 0.77 | 0.85 |
| Shear stiffness (weft) | gf/cm · deg | 0.74 | 0.79 |
| Average | gf/cm · deg | 0.755 | 0.82 |
| Shear hysteresis (warp) | gf/cm | 0.65 | 0.68 |
| Shear hysteresis (weft) | gf/cm | 0.46 | 0.50 |
| Average | gf/cm | 0.555 | 0.59 |
| Mean value of the coefficient of friction (warp) | — | 0.094 | 0.101 |
| Mean value of the coefficient of friction (weft) | — | 0.125 | 0.135 |
| Average | — | 0.1095 | 0.118 |
| Mean deviation of surface roughness (warp) | micron | 1.47 | 1.50 |
| Mean deviation of surface roughness (weft) | micron | 0.98 | 1.02 |
| Average | micron | 1.225 | 1.26 |
| Thickness | mm | 0.243 | 0.246 |
| Weight per unit area | gf/m² | 83 | 85 |
| Sensuous test | | | |
| Softness | | ○ | X |
| Smoothness | | ○ | X |

As compared with the conventional woven fabric according to Comparative Example 2, which was produced from raw cotton (Sea Island cotton) having great fiber lengths, the woven fabric according to Example 2 had a slightly smooth surface (i.e., smoothness), slipperiness (i.e., smaller MIU and SMD in the characteristics of woven fabrics), softness (i.e., capable of bending softly), drape properties (i.e., smaller G and 2HG; see FIG. 5), and it also exhibited supple and soft hands in the sensuous test.

Example 3

A mass of Sea Island cotton was broken into small pieces by opening, and allowed to pass through a flat carding machine to form a sliver, which was then supplied to a combing machine adjusted so as to leave only longer fibers, thereby obtaining a sliver made of cotton fibers each having a long fiber length. The sliver thus obtained was successively supplied to a drawing frame and a flyer frame to form a roving having a fineness equivalent to 5's count. The roving was then subjected to drafting at a ratio of about 20 times in a spinning frame, and given a primary twist of 50 times per inch to form a single yarn having a fineness equivalent to 100's count. Further, the single yarn was given a finishing twist of 45 times per inch to form a two folded yarn.

The fiber length of cotton fibers in the sliver after passing through the combing machine was ranging from 1.8 to 2.0 inches as measured by a sorter, and the effective fiber length was 1.91 inches. The cotton fibers had a micronaire fineness of 3.5 μg/inch.

The weaving was carried out as follows. The two folded yarn as described above was provided as 5700 end warp yarns, and then subjected to warping, followed by the weaving of a plain weave fabric as a gray fabric using a loom (Toyada Automatic Loom Works, Ltd.). The gray fabric was bleached with a solution of hydrogen peroxide, and then subjected to conventional mercerization and treatment with a finishing agent such as softener, thereby obtaining a finished woven fabric.

The woven fabric thus obtained was cut into three specimens each having a size of 20 cm×20 cm, and evaluated by KES testers for various characteristics relating to the hands of woven fabrics, such as weight per unit area, tensile properties, bending properties, shearing properties, thickness/compression properties and surface properties. The gloss properties were determined by placing three specimens each having a size of 4.5 cm×5.0 cm in layers on a black paper and measuring the gloss by the Jeffrie's method using an automatic goniophotometer (Murakami Shikisai Co., Ltd.).

The weight per unit area was determined by weighing the specimens and expressed in gf/m². The tensile properties and thickness/compression properties were determined by the standard methods of measurements using KES testers.

The results are shown in Table 3. The woven fabric of this example had a cover factor (K) of 31.0, which was calculated by Equation (1), where $n=1$, $S_t=2$ and $S_w=2$.

Comparative Example 3

A mass of Sea Island cotton was allowed to pass through a flat carding machine to form a sliver, which was then supplied to a combing machine adjusted to ordinary conditions, thereby obtaining a sliver made of cotton fibers each having a great fiber length. The sliver thus obtained was successively supplied to a drawing frame and a flyer frame to form a roving having a fineness equivalent to 5's count. The roving was then subjected to drafting at a ratio of about 20 times in a spinning frame, and given a primary twist of 50 times per inch to form a single yarn having a fineness equivalent to 100's count. Further, the single yarn was given a finishing twist of 45 times per inch to form a two folded yarn of 100's count, from which a plain weave fabric was produced in the same manner as described in Example 1. The fiber length of Sea Island cotton fibers was ranging from the minimum fiber length of 1.1 inches to the maximum fiber length of 2.0 inches as measured by a sorter, and the effective fiber length was 1.6 inches. The cotton fibers had a micronaire fineness of 3.5 μg/inch.

The woven fabric thus obtained was evaluated for various characteristics. The results are shown in Table 3. The woven fabric of this comparative example had a cover factor (K) of 30.7, which was calculated by Equation (1), where $n=1$, $S_t=2$ and $S_w=2$.

TABLE 3

| Characteristics | Unit | Example 3 | Comp. Ex. 3 |
|---|---|---|---|
| Effective fiber length | inch | 1.91 | 1.58 |
| Micronaire fineness | μg/inch | 3.5 | 3.5 |
| English count (warp) | | 100/2 | 100/2 |
| English count (weft) | | 100/2 | 100/2 |
| Number of threads per unit length (warp) | ends/inch | 141 | 140 |
| Number of threads per unit length (weft) | picks/inch | 78 | 77 |
| Cover factor | | 31.0 | 30.7 |
| Tensile elongation (warp) | % | 4.9 | 4.5 |
| Tensile elongation (weft) | % | 5.9 | 5.4 |
| Average | % | 5.4 | 4.95 |
| Tensile resilience (warp) | % | 52.2 | 50.5 |
| Tensile resilience (weft) | % | 46.3 | 45.3 |
| Average | % | 49.25 | 47.9 |
| Bending rigidity (warp) | gf · cm²/cm | 0.045 | 0.051 |

TABLE 3-continued

| Characteristics | Unit | Example 3 | Comp. Ex. 3 |
|---|---|---|---|
| Bending rigidity (weft) | gf · cm²/cm | 0.030 | 0.037 |
| Average | gf · cm²/cm | 0.0375 | 0.044 |
| Bending hysteresis (warp) | gf · cm/cm | 0.033 | 0.036 |
| Bending hysteresis (weft) | gf · cm/cm | 0.022 | 0.027 |
| Average | gf · cm/cm | 0.0275 | 0.0315 |
| Shear stiffness (warp) | gf/cm · deg | 0.90 | 0.97 |
| Shear stiffness (weft) | gf/cm · deg | 0.88 | 0.96 |
| Average | gf/cm · deg | 0.89 | 0.965 |
| Shear hysteresis (warp) | gf/cm | 1.15 | 1.33 |
| Shear hysteresis (weft) | gf/cm | 0.96 | 1.02 |
| Average | gf/cm | 1.055 | 1.175 |
| Mean value of the coefficient of friction (warp) | — | 0.129 | 0.134 |
| Mean value of the coefficient of friction (weft) | — | 0.139 | 0.1442 |
| Average | — | 0.134 | 0.1391 |
| Mean deviation of surface roughness (warp) | micron | 2.54 | 3.04 |
| Mean deviation of surface roughness (weft) | micron | 1.39 | 1.46 |
| Average | micron | 1.965 | 2.25 |
| Thickness | mm | 0.369 | 0.379 |
| Weight per unit area | gf/m² | 107 | 106 |
| Gloss value | | 0.9 | 0.7 |
| Sensuous test | | | |
| Softness | | ○ | X |
| Smoothness | | ○ | X |
| Gloss | | ○ | X |

As compared with the conventional woven fabric made of a spun yarn of middle cotton count according to Comparative Example 3, which was produced from raw cotton (Sea Island cotton), the woven fabric according to Example 3 had softness (i.e., capable of bending softly), suppleness, drape properties (i.e., smaller B, G and 2HG) and gloss (i.e., higher gloss value), and it also exhibited supple, soft and glossy hands in the sensuous test.

Example 4

A mass of Sea island cotton was broken into small pieces by opening, and allowed to pass through a flat carding machine to form a sliver, which was then supplied to a combing machine adjusted so as to leave only longer fibers, thereby obtaining a sliver made of cotton fibers each having a great fiber length. Separately, polyester staple fibers each having a size of 0.7 denier×51 mm were supplied to a flat carding machine to form a sliver, which was then supplied to a drawing frame for preparing a sliver made of raw cotton fibers and polyester staple fibers in admixture at a weight ratio of 50:50. In the same manner as described in Example 3, two single yarns of 100's count each were combined together to form a two folded yarn.

From this polyester-cotton blended yarn, a flat weave fabric was produced in the same manner as described in Example 3, except that the gray fabric was breached with a solution of sodium hypochlorite.

The woven fabric thus obtained was evaluated for various characteristics. The results are shown in Table 4. The woven fabric of this example had a cover factor (K) of 30.7, which was calculated by Equation (1), where $n=1$, $S_t=2$ and $S_w=2$.

Comparative Example 4

A mass of Sea island cotton was broken into small pieces by opening, and allowed to pass through a flat carding machine to form a sliver, which was then supplied to a combing machine adjusted so as to leave only longer fibers, thereby obtaining a silver made of cotton fibers each having a great fiber length. Separately, polyester staple fibers each having a size of 0.7 denier×51 mm were supplied to a flat carding machine to form a sliver, which was then supplied to a drawing frame for preparing a silver made of raw cotton fibers and polyester staple fibers in admixture at a weight ratio of 50:50. In the same manner as described in Example 4, two single yarns of 100's count each were combined together to form a two folded yarn, from which a flat weave fabric was produced.

The woven fabric thus obtained was evaluated for various characteristics. The results are shown in Table 4. The woven fabric of this example had a cover factor (K) of 30.4, which was calculated by Equation (1), where $n=1$, $S_t=2$ and $S_w=2$.

TABLE 4

| Characteristics | Unit | Example 4 | Comp. Ex. 4 |
|---|---|---|---|
| Effective fiber length | inch | 1.91 | 1.58 |
| Micronaire fineness | μg/inch | 3.5 | 3.5 |
| English count (warp) | | 100/2 | 100/2 |
| English count (weft) | | 100/2 | 100/2 |
| Number of threads per unit length (warp) | ends/inch | 140 | 139 |
| Number of threads per unit length (weft) | picks/inch | 77 | 76 |
| Cover factor | | 30.7 | 30.4 |
| Tensile elongation (warp) | % | 4.2 | 3.9 |
| Tensile elongation (weft) | % | 3.8 | 3.4 |
| Average | % | 4.0 | 3.65 |
| Tensile resilience (warp) | % | 53.8 | 52.9 |
| Tensile resilience (weft) | % | 47.9 | 47.1 |
| Average | % | 50.85 | 50.0 |
| Bending rigidity (warp) | gf · cm²/cm | 0.049 | 0.055 |
| Bending rigidity (weft) | gf · cm²/cm | 0.031 | 0.040 |
| Average | gf · cm²/cm | 0.040 | 0.0475 |
| Bending hysteresis (warp) | gf · cm/cm | 0.040 | 0.047 |
| Bending hysteresis (weft) | gf · cm/cm | 0.038 | 0.044 |
| Average | gf · cm/cm | 0.039 | 0.0455 |
| Shear stiffness (warp) | gf/cm · deg | 1.02 | 1.18 |
| Shear stiffness (weft) | gf/cm · deg | 0.97 | 1.02 |
| Average | gf/cm · deg | 0.995 | 1.10 |
| Shear hysteresis (warp) | gf/cm | 1.20 | 1.40 |
| Shear hysteresis (weft) | gf/cm | 1.09 | 1.15 |
| Average | gf/cm | 1.145 | 1.275 |
| Mean value of the coefficient of friction (warp) | — | 0.131 | 0.137 |
| Mean value of the coefficient of friction (weft) | — | 0.139 | 0.144 |
| Average | — | 0.135 | 0.1405 |
| Mean deviation of surface roughness (warp) | micron | 2.57 | 2.98 |
| Mean deviation of surface roughness (weft) | micron | 1.40 | 1.52 |
| Average | micron | 1.985 | 2.25 |
| Thickness | mm | 0.352 | 0.357 |
| Weight per unit area | gf/m² | 105 | 103 |
| Gloss value | | 0.9 | 0.7 |
| Sensuous test | | | |
| Softness | | ○ | X |
| Smoothness | | ○ | X |
| Gloss | | ○ | X |

As compared with the conventional woven fabric made of a spun yarn of middle cotton count according to Comparative Example 4, which was produced from raw cotton (Sea Island cotton), the woven fabric according to Example 4 had softness (i.e., capable of bending softly), suppleness, drape properties (i.e., smaller B, G and 2HG) and gloss (i.e., higher gloss value), and it also exhibited supple, soft and glossy hands in the sensuous test.

Example 5

A mass of Sea Island cotton was broken into small pieces by opening, and allowed to pass through a fiat carding machine to form a silver, which was then supplied to a combing machine adjusted so as to leave only longer fibers, thereby obtaining a sliver made of cotton fibers each having a great fiber length. The sliver thus obtained was successively supplied to a drawing frame and a flyer frame to form a roving having a fineness equivalent to 3's count. The roving was then subjected to drafting at a ratio of about 15 times in a spinning frame, and given a primary twist of 20 times per inch to form a single yarn having a fineness equivalent to 40's count. Further, the single yarn was given a finishing twist of 15 times per inch to form a two folded yarn.

The fiber length of cotton fibers in the sliver after passing through the combing machine was ranging from 1.8 to 2.0 inches as measured by a sorter, and the effective fiber length was 1.90 inches. The cotton fibers had a micronaire fineness of 3.5 μg/inch.

The weaving was carried out as follows. The two folded yarn as described above was provided as 4100 end warp yarns, and then subjected to warping, followed by the weaving of a plain weave fabric as a gray fabric using a loom (Toyada Automatic Loom Works, Ltd.). The gray fabric was bleached with a solution of hydrogen peroxide, and then subjected to conventional mercerization and treatment with a finishing agent such as softener, thereby obtaining a finished woven fabric.

The woven fabric thus obtained was cut into three specimens each having a size of 20 cm×20 cm, and evaluated by KES testers for various characteristics relating to the hands of woven fabrics, such as weight per unit area, tensile properties, bending properties, shearing properties, thickness/compression properties and surface properties. The gloss properties were determined with three specimens each having a size of 4.5 cm×5.0 cm.

The weight per unit area was determined by weighing the specimens and expressed in gf/m$^2$. The tensile properties and thickness/compression properties were determined by the standard methods of measurements using KES testers.

The gloss properties were determined by the Jeffrie's method using an automatic goniometer (Murakami Shikisai Co., Ltd.).

The warmth retaining properties were determined using a warmth retaining tester (Daiei Kagaku Seiki Seisakusho, Co., Ltd.). The warmth retaining factor was calculated by Equation (3), where parameters a and b denoting the values of power consumption (W) for the test period of 2 hours were 25.22 and 22.19 W, respectively. These parameters found in Comparative Example 5, Example 6 and Comparative Example 6 have the same meaning.

The results are shown in Table 5. The woven fabric of this example had a cover factor (K) of 25.7, which was calculated by Equation (1), where $n=1$, $S_t=2$ and $S_w=2$.

Comparative Example 5

A mass of Sea Island cotton was broken into small pieces by opening, and allowed to pass through a flat carding machine to form a sliver, which was then supplied to a combing machine adjusted so as to leave only longer fibers, thereby obtaining a sliver made of cotton fibers each having a great fiber length. The sliver thus obtained was successively supplied to a drawing frame and a flyer frame to form a roving having a fineness equivalent to 3's count. The roving was then subjected to drafting at a ratio of about 15 times in a spinning frame, and given a primary twist of 20 times per inch to form a single yarn having a fineness equivalent to 40's count. Further, the single yarn was given a finishing twist of 15 times per inch to form a two folded yarn of 40's count, from which a woven fabric was produced in the same manner as described in Example 5.

The fiber length of Sea Island cotton fibers was ranging from the minimum fiber length of 1.1 inches to the maximum fiber length of 2.0 inches as measured by a sorter, and the effective fiber length was 1.59 inches. The cotton fibers had a micronaire fineness of 3.4 μg/inch.

The woven fabric thus obtained was evaluated for various characteristics. The results are shown in Table 5. The woven fabric of this example had a cover factor (K) of 26.1, which was calculated by Equation (1), where $n=1$, $S_t=1$ and $S_w=1$. The parameters a and b in the definition of a warmth retaining factor was 25.13 and 22.24 W, respectively.

TABLE 5

| Characteristics | Unit | Example 5 | Comp. Ex. 5 |
|---|---|---|---|
| Effective fiber length | inch | 1.90 | 1.59 |
| Micronaire fineness | μg/inch | 3.5 | 3.4 |
| English count (warp) | | 40/2 | 40/2 |
| English count (weft) | | 40/2 | 40/2 |
| Number of threads per unit length (warp) | ends/inch | 70 | 71 |
| Number of threads per unit length (weft) | picks/inch | 45 | 46 |
| Cover factor | | 25.7 | 26.1 |
| Tensile elongatiion (warp) | % | 5.3 | 5.0 |
| Tensile elongatiion (weft) | % | 6.2 | 6.0 |
| Average | % | 5.75 | 5.5 |
| Tensile resilience (warp) | % | 48.9 | 50.2 |
| Tensile resilience (weft) | % | 42.8 | 43.0 |
| Average | % | 45.85 | 46.6 |
| Bending rigidity (warp) | gf · cm$^2$/cm | 0.082 | 0.090 |
| Bending rigidity (weft) | gf · cm$^2$/cm | 0.062 | 0.068 |
| Average | gf · cm$^2$/cm | 0.072 | 0.079 |
| Bending hysteresis (warp) | gf · cm/cm | 0.070 | 0.077 |
| Bending hysteresis (weft) | gf · cm/cm | 0.058 | 0.063 |
| Average | gf · cm/cm | 0.064 | 0.070 |
| Shear stiffness (warp) | gf/cm · deg | 1.25 | 1.35 |
| Shear stiffness (weft) | gf/cm · deg | 1.20 | 1.30 |
| Average | gf/cm · deg | 1.225 | 1.325 |
| Shear hysteresis (warp) | gf/cm | 1.34 | 1.46 |
| Shear hysteresis (weft) | gf/cm | 1.12 | 1.28 |
| Average | gf/cm | 1.23 | 1.37 |
| Mean value of the coefficient of friction (warp) | — | 0.131 | 0.137 |
| Mean value of the coefficient of friction (weft) | — | 0.142 | 0.146 |
| Average | — | 0.1365 | 0.1415 |
| Mean deviation of surface roughness (warp) | micron | 3.08 | 3.05 |
| Mean deviation of surface roughness (weft) | micron | 2.01 | 2.12 |
| Average | micron | 2.545 | 2.585 |
| Thickness | mm | 0.487 | 0.434 |
| Weight per unit area | gf/m$^2$ | 116 | 115 |
| Gloss value | | 1.2 | 0.9 |
| Warmth retaining factor | % | 12.0 | 11.5 |
| Sensuous test | | | |
| Softness | | ○ | X |
| Suppleness | | ○ | X |
| Thickness | | ○ | X |
| Gloss | | ○ | X |

As compared with the conventional woven fabric made of a spun yarn of high cotton count according to Comparative Example 5, which was produced from raw cotton (Sea Island cotton), the woven fabric according to Example 5 had softness (i.e., capable of bending softly), suppleness, drape properties (i.e., smaller B, G and 2HG), gloss (i.e., higher gloss value) and a higher warmth retaining factor, and it also exhibited supple, soft and glossy hands in the sensuous test.

Example 6

A mass of Sea island cotton was broken into small pieces by opening, and allowed to pass through a flat carding machine to form a sliver, which was then supplied to a combing machine adjusted so as to leave only longer fibers, thereby obtaining a sliver made of cotton fibers each having a great fiber length. Separately, polyester staple fibers each having a size of 0.7 denier×51 mm were supplied to a fiat carding machine to form a sliver, which was then supplied to a drawing frame for preparing a sliver made of raw cotton fibers and polyester staple fibers in admixture at a weight ratio of 50:50. In the same manner as described in Example 5, two single yarns of 40's count each were combined together to form a two folded yarn.

From this polyester-cotton blended yarn, a woven fabric was produced in the same manner as described in Example 5, except that the gray fabric was breached with a solution of sodium hypochlorite.

The woven fabric thus obtained was evaluated for various characteristics. The results are shown in Table 6. The woven fabric of this example had a cover factor (K) of 25.3, which was calculated by Equation (1), where $n-1$, $S_t=2$ and $S_w=2$. The parameters a and b in the definition of a warmth retaining factor were 25.18 and 22.21 W, respectively.

Comparative Example 6

A mass of Sea island cotton was broken into small pieces by opening, and allowed to pass through a fiat carding machine to form a silver, which was then supplied to a combing machine adjusted so as to leave only longer fibers, thereby obtaining a sliver made of cotton fibers each having a great fiber length. Separately, polyester staple fibers each having a size of 0.7 denier×51 mm were supplied to a flat carding machine to form a sliver, which was then supplied to a drawing frame for preparing a sliver made of raw cotton fibers and polyester staple fibers in admixture at a weight ratio of 50:50. In the same manner as described in Example 6, two single yarns of 100's count each were combined together to form a two folded yarn, from which a woven fabric was produced.

The woven fabric thus obtained was evaluated for various characteristics. The results are shown in Table 6. The woven fabric of this example had a cover factor (K) of 25.5, which was calculated by Equation (1), where $n=1$, $S_t=2$ and $S_w=2$. The parameters a and b in the definition of a warmth retaining factor were 25.15 and 22.33 W, respectively.

TABLE 6

| Characteristics | Unit | Example 6 | Comp. Ex. 6 |
|---|---|---|---|
| Effective fiber length | inch | 1.93 | 1.57 |
| Micronaire fineness | μg/inch | 3.5 | 3.7 |
| English count (warp) | | 40/2 | 40/2 |
| English count (weft) | | 40/2 | 40/2 |
| Number of threads per unit length (warp) | ends/inch | 69 | 70 |
| Number of threads per unit length (weft) | picks/inch | 44 | 44 |
| Cover factor | | 25.3 | 25.5 |
| Tensile elongatiion (warp) | % | 5.0 | 4.8 |
| Tensile elongatiion (weft) | % | 6.0 | 5.8 |
| Average | % | 5.5 | 5.3 |
| Tensile resilience (warp) | % | 49.4 | 49.8 |
| Tensile resilience (weft) | % | 43.4 | 43.8 |
| Average | % | 46.4 | 46.8 |
| Bending rigidity (warp) | gf · cm²/cm | 0.079 | 0.088 |
| Bending rigidity (weft) | gf · cm²/cm | 0.060 | 0.065 |
| Average | gf · cm²/cm | 0.0695 | 0.0765 |
| Bending hysteresis (warp) | gf · cm/cm | 0.078 | 0.085 |
| Bending hysteresis (weft) | gf · cm/cm | 0.065 | 0.069 |
| Average | gf · cm/cm | 0.0715 | 0.077 |
| Shear stiffness (warp) | gf/cm · deg | 1.44 | 1.59 |
| Shear stiffness (weft) | gf/cm · deg | 1.31 | 1.41 |
| Average | gf/cm · deg | 1.375 | 1.50 |
| Shear hysteresis (warp) | gf/cm | 1.49 | 1.63 |
| Shear hysteresis (weft) | gf/cm | 1.18 | 1.32 |
| Average | gf/cm | 1.335 | 1.475 |
| Mean value of the coefficient of friction (warp) | — | 0.135 | 0.145 |
| Mean value of the coefficient of friction (weft) | — | 0.139 | 0.149 |
| Average | — | 0.137 | 0.147 |
| Mean deviation of surface roughness (warp) | micron | 3.31 | 3.20 |
| Mean deviation of surface roughness (weft) | micron | 2.20 | 2.11 |
| Average | micron | 2.755 | 2.655 |
| Thickness | mm | 0.451 | 0.420 |
| Weight per unit area | gf/m² | 118 | 117 |
| Gloss value | | 1.3 | 1.0 |
| Warmth retaining factor | % | 11.8 | 11.2 |
| Sensuous test | | | |
| Softness | | ○ | X |
| Suppleness | | ○ | X |
| Thickness | | ○ | X |
| Gloss | | ○ | X |

As compared with the conventional woven fabric made of a spun yarn of high cotton count according to Comparative Example 6, which was produced from raw cotton (Sea Island cotton), the woven fabric according to Example 6 had softness (i.e., capable of bending softly), suppleness, drape properties (i.e., smaller B, G and 2HG), gloss (i.e., higher gloss value) and a higher warmth retaining factor, and it also exhibited supple, soft, thick and glossy hands in the sensuous test.

Example 7

A mass of Sea Island cotton was broken into small pieces by opening, and allowed to pass through a flat carding machine to form a sliver, which was then supplied to a combing machine adjusted so as to leave only longer fibers, thereby obtaining a sliver made of cotton fibers each having a great fiber length. The sliver thus obtained was successively supplied to a drawing frame and a flyer frame to form a roving having a fineness equivalent to 3's count. The roving was then subjected to drafting at a ratio of about 20 times in a spinning frame, and given a primary twist of 54 times per inch to form a single yarn having a fineness equivalent to 60's count. Further, the single yarn was given a finishing twist of 50 times per inch to form a two folded yarn.

The fiber length of cotton fibers in the sliver after passing through the combing machine was ranging from 1.8 to 2.0 inches as measured by a sorter, and the effective fiber length was 1.92 inches. The cotton fibers had a micronaire fineness of 3.4 μg/inch.

Using a circular knitting machine having an aperture of 30 inches (Hukuhara Seisakusho, Co., Ltd.), a 28-gauge gray fabric was produced. The gray fabric was bleached with a solution of hydrogen peroxide, and then subjected to conventional treatment with a finishing agent such as a softener, thereby obtaining a finished knit fabric.

The knit fabric thus obtained was cut into three specimens each having a size of 20 cm×20 cm, and evaluated by KES testers for various characteristics relating to the hands of knit fabrics, such as weight per unit area, tensile properties, bending properties, shearing properties, thickness/compression properties and surface properties.

The weight per unit area was determined by weighing the specimens and expressed in gf/m$^2$. The tensile properties and thickness/compression properties were determined by the standard methods of measurements using KES testers.

The results are shown in Table 7.

Comparative Example 7

A mass of Sea Island cotton was allowed to pass through a flat carding machine to form a sliver, which was then supplied to a combing machine adjusted to the ordinary conditions, thereby obtaining a sliver made of cotton fibers each having a great fiber length. The sliver thus obtained was successively supplied to a drawing frame and a flyer frame to form a roving having a fineness equivalent to 3's count. The roving was then subjected to drafting at a ratio of about 20 times in a spinning frame, and given a primary twist of 54 times per inch to form a single yarn having a fineness equivalent to 60's count. Further, the single yarn was given a finishing twist of 50 times per inch to form a two folded yarn of 60's count, from which a knit fabric was produced in the same manner as described in Example 7.

The fiber length of Sea Island cotton fibers was ranging from the minimum fiber length of 1.1 inches to the maximum fiber length of 2.0 inches as measured by a sorter, and the effective fiber length was 1.57 inches. The cotton fibers had a micronaire fineness of 3.5 μg/inch.

The knit fabric thus obtained was evaluated for various characteristics. The results are shown in Table 7.

TABLE 7

| Characteristics | Unit | Example 7 | Comp. Ex. 7 |
|---|---|---|---|
| Effective fiber length | inch | 1.92 | 1.57 |
| Micronaire fineness | μg/inch | 3.4 | 3.5 |
| English count | | 60/2 | 60/2 |
| Gauge | needles/inch | 28 | 28 |
| Tensile elongatiion (wale) | % | 29.0 | 28.1 |
| Tensile elongatiion (course) | % | 57.2 | 55.8 |
| Average | % | 43.1 | 41.95 |
| Tensile resilience (wale) | % | 33.6 | 32.0 |
| Tensile resilience (course) | % | 25.2 | 24.0 |
| Average | % | 29.4 | 28.0 |
| Bending rigidity (wale) | gf · cm$^2$/cm | 0.009 | 0.012 |
| Bending rigidity (course) | gf · cm$^2$/cm | 0.001 | 0.002 |
| Average | gf · cm$^2$/cm | 0.005 | 0.007 |
| Bending hysteresis (wale) | gf · cm/cm | 0.013 | 0.018 |
| Bending hysteresis (course) | gf · cm/cm | 0.002 | 0.004 |
| Average | gf · cm/cm | 0.0075 | 0.011 |
| Shear stiffness (wale) | gf/cm · deg | 0.73 | 0.84 |
| Shear stiffness (course) | gf/cm · deg | 0.68 | 0.75 |
| Average | gf/cm · deg | 0.705 | 0.795 |
| Shear hysteresis (wale) | gf/cm | 2.28 | 2.69 |
| Shear hysteresis (course) | gf/cm | 2.52 | 2.84 |
| Average | gf/cm | 2.40 | 2.765 |

TABLE 7-continued

| Characteristics | Unit | Example 7 | Comp. Ex. 7 |
|---|---|---|---|
| Mean value of the coefficient of friction (wale) | — | 0.158 | 0.169 |
| Mean value of the coefficient of friction (course) | — | 0.172 | 0.187 |
| Average | — | 0.165 | 0.178 |
| Mean deviation of surface roughness (wale) | micron | 2.28 | 2.69 |
| Mean deviation of surface roughness (course) | micron | 5.08 | 6.52 |
| Average | micrion | 3.68 | 4.605 |
| Thickness | mm | 0.760 | 0.741 |
| Weight per unit area | gf/m$^2$ | 152 | 151 |
| Gloss value | | 0.9 | 0.7 |
| Sensuous test | | | |
| Flexibility | | ○ | X |
| Softness | | ○ | X |
| Gloss | | ○ | X |

As compared with the conventional knit fabric according to Comparative Example 7, which was produced from raw cotton (Sea Island cotton), the knit fabric according to Example 7 had flexibility (i.e., capable of bending softly), softness (i.e., smaller B, G and 2HG) and gloss (i.e., higher gloss value), and it also exhibited flexible, soft and glossy hands in the sensuous test.

Example 8

A mass of Sea island cotton was broken into small pieces by opening, and allowed to pass through a flat carding machine to form a sliver, which was then supplied to a combing machine adjusted so as to leave only longer fibers, thereby obtaining a sliver made of cotton fibers each having a great fiber length. Separately, polyester staple fibers each having a size of 0.7 denier×51 mm were supplied to a flat carding machine to form a sliver, which was then supplied to a drawing frame for preparing a sliver made of raw cotton fibers and polyester staple fibers in admixture at a weight ratio of 50:50. In the same manner as described in Example 7, two single yarns of 60's count each were combined together to form a two folded yarn.

From this polyester-cotton blended yarn, a woven fabric was prepared in the same manner as described in Example 7, except that the gray fabric was breached with a solution of sodium hypochlorite.

The knit fabric thus obtained was evaluated for various characteristics. The results are shown in Table 8.

Comparative Example 8

A mass of Sea island cotton was broken into small pieces by opening, and allowed to pass through a flat carding machine to form a sliver, which was then supplied to a combing machine adjusted so as to leave only longer fibers, thereby obtaining a sliver made of cotton fibers each having a great fiber length. Separately, polyester staple fibers each having a size of 0.7 denier×51 mm were supplied to a flat carding machine to form a sliver, which was then supplied to a drawing frame tier preparing a sliver made of raw cotton fibers and polyester staple fibers in admixture at a weight ratio of 50:50. In the same manner as described in Example 8, two single yarns of 60's count each were combined together to form a two folded yarn, from which a knit fabric was produced.

The knit fabric thus obtained was evaluated for various characteristics. The results are shown in Table 8.

TABLE 8

| Characteristics | Unit | Example 8 | Comp. Ex. 8 |
|---|---|---|---|
| Effective fiber length | inch | 1.91 | 1.58 |
| Micronaire fineness | μg/inch | 3.5 | 3.6 |
| English count | | 60/2 | 60/2 |
| Gauge | needles/inch | 28 | 28 |
| Tensile elongatiion (wale) | % | 27.9 | 26.8 |
| Tensile elongatiion (course) | % | 56.1 | 54.8 |
| Average | % | 42.0 | 40.8 |
| Tensile resilience (wale) | % | 34.2 | 33.3 |
| Tensile resilience (course) | % | 26.8 | 25.7 |
| Average | % | 30.5 | 29.5 |
| Bending rigidity (wale) | gf · cm²/cm | 0.008 | 0.011 |
| Bending rigidity (course) | gf · cm²/cm | 0.001 | 0.002 |
| Average | gf · cm²/cm | 0.0045 | 0.0065 |
| Bending hysteresis (wale) | gf · cm/cm | 0.012 | 0.017 |
| Bending hysteresis (course) | gf · cm/cm | 0.002 | 0.004 |
| Average | gf · cm/cm | 0.007 | 0.0105 |
| Shear stiffness (wale) | gf/cm · deg | 0.70 | 0.82 |
| Shear stiffness (course) | gf/cm · deg | 0.65 | 0.74 |
| Average | gf/cm · deg | 0.675 | 0.78 |
| Shear hysteresis (wale) | gf/cm | 2.25 | 2.59 |
| Shear hysteresis (course) | gf/cm | 2.50 | 2.79 |
| Average | gf/cm | 2.375 | 2.69 |
| Mean value of the coefficient of friction (wale) | — | 0.162 | 0.172 |
| Mean value of the coefficient of friction (course) | — | 0.178 | 0.188 |
| Average | — | 0.170 | 0.180 |
| Mean deviation of surface roughness (wale) | micron | 2.28 | 2.88 |
| Mean deviation of surface roughness (course) | micron | 5.58 | 6.50 |
| Average | micron | 3.93 | 4.69 |
| Thickness | mm | 0.743 | 0.733 |
| Weight per unit area | gf/m² | 148 | 149 |
| Gloss value | | 1.0 | 0.8 |
| Sensuous test | | | |
| Flexibility | | ○ | X |
| Softness | | ○ | X |
| Gloss | | ○ | X |

As compared with the conventional knit fabric according to Comparative Example 8, which was produced from raw cotton (Sea Island cotton), the knit fabric according to Example 8 had flexibility (i.e., capable of bending softly), softness (i.e., smaller B, G and 2HG) and gloss (i.e., higher gloss value), and it also exhibited flexible, soft and glossy hands in the sensuous test.

Example 9

A mass of Sea Island cotton was broken into small pieces by opening, and allowed to pass through a flat carding machine to form a sliver, which was then supplied to a combing machine adjusted so as to leave only longer fibers, thereby obtaining a sliver made of cotton fibers each having a great fiber length. The sliver thus obtained was successively supplied to a drawing frame and a flyer frame to form a roving having a fineness equivalent to 2's count. The roving was then subjected to drafting at a ratio of about 10 times in a spinning frame, and given a primary twist of 20 times per inch to form a single yarn having a fineness equivalent to 20's count. Further, the single yarn was given a finishing twist of 15 times per inch to form a two folded yarn.

The fiber length of cotton fibers in the sliver after passing through the combing machine was ranging from 1.8 to 2.0 inches as measured by a sorter, and the effective fiber length was 1.90 inches. The cotton fibers had a micronaire fineness of 3.5 μg/inch.

Using a circular knitting machine having an aperture or 30 inches (Hukuhara Seisakusho, Co., Ltd.), a 14-gauge gray fabric was produced by plain knitting. The gray fabric was bleached with a solution of hydrogen peroxide, and then subjected to conventional treatment with a finishing agent such as a softener, thereby obtaining a finished knit fabric.

The knit fabric thus obtained was cut into three specimens each having a size of 20 cm×20 cm, and evaluated by KES testers for various characteristics relating to the hands of knit fabrics, such as weight per unit area, tensile properties, bending properties, shearing properties, thickness/compression properties and surface properties. The gloss properties were determined with three specimens each having a size of 4.5 cm×5.0 cm.

The weight per unit area was determined by weighing the specimens and expressed in gf/m². The tensile properties and thickness/compression properties were determined by the standard methods of measurements using KES testers.

The gloss properties were determined by the Jeffrie's method using an automatic goniometer (Murakami Shikisai Co., Ltd.).

The results are shown in Table 9.

Comparative Example 9

Masses of American cotton, Pakistani cotton and Egyptian cotton were blended by a scutching machine, and allowed to pass through a flat carding machine to form a sliver, which was successively supplied to a drawing frame and a flyer frame to form a roving having a fineness equivalent to 2's count. The roving was then subjected to drafting at a ratio of about 10 times in a spinning frame, and given a primary twist of 20 times per inch to form a single yarn having a fineness equivalent to 20's count. Further, the single yarn was given a finishing twist of 15 times per inch to form a two folded yarn of 20's count, from which a knit fabric was produced in the same manner as described in Example 9.

The fiber length of Sea Island cotton fibers was ranging from the minimum fiber length of 0.8 inches to the maximum fiber length of 1.7 inches as measured by a sorter, and the effective fiber length was 1.26 inches. The cotton fibers had a micronaire fineness of 4.0 μg/inch.

The knit fabric thus obtained was evaluated for various characteristics. The results are shown in Table 9.

TABLE 9

| Characteristics | Unit | Example 9 | Comp. Ex. 9 |
|---|---|---|---|
| Effective fiber length | inch | 1.90 | 1.20 |
| Micronaire fineness | μg/inch | 3.5 | 4.0 |
| English count | | 20/2 | 20/2 |
| Gauge | needles/inch | 14 | 14 |
| Tensile elongatiion (wale) | % | 16.8 | 14.0 |
| Tensile elongatiion (course) | % | 26.2 | 22.6 |
| Average | % | 21.5 | 18.3 |
| Tensile resilience (wale) | % | 25.3 | 26.2 |
| Tensile resilience (course) | % | 20.1 | 20.9 |
| Average | % | 22.7 | 23.6 |
| Bending rigidity (wale) | gf · cm²/cm | 0.041 | 0.058 |
| Bending rigidity (course) | gf · cm²/cm | 0.019 | 0.027 |
| Average | gf · cm²/cm | 0.030 | 0.043 |
| Bending hysteresis (wale) | gf · cm/cm | 0.038 | 0.051 |
| Bending hysteresis (course) | gf · cm/cm | 0.015 | 0.026 |
| Average | gf · cm/cm | 0.0265 | 0.039 |
| Shear stiffness (wale) | gf/cm · deg | 0.50 | 0.57 |
| Shear stiffness (course) | gf/cm · deg | 0.48 | 0.56 |
| Average | gf/cm · deg | 0.49 | 0.565 |
| Shear hysteresis (wale) | gf/cm | 2.52 | 2.64 |
| Shear hysteresis (course) | gf/cm | 2.78 | 2.91 |
| Average | gf/cm | 2.65 | 2.775 |

TABLE 9-continued

| Characteristics | Unit | Example 9 | Comp. Ex. 9 |
|---|---|---|---|
| Mean value of the coefficient of friction (wale) | — | 0.187 | 0.201 |
| Mean value of the coefficient of friction (course) | — | 0.225 | 0.228 |
| Average | — | 0.206 | 0.2145 |
| Mean deviation of surface roughness (wale) | micron | 4.45 | 4.34 |
| Mean deviation of surface roughness (course) | micron | 14.95 | 14.65 |
| Average | micron | 9.70 | 9.495 |
| Thickness | mm | 1.58 | 1.36 |
| Weight per unit area | gf/m$^2$ | 219 | 223 |
| Gloss value | | 1.1 | 0.8 |
| Sensuous test | | | |
| Suppleness | | ○ | X |
| Bulkiness | | ○ | X |
| Gloss | | ○ | X |

As compared with the conventional knit fabric according to Comparative Example 9, which was produced from raw cotton (Sea Island cotton), the knit fabric according to Example 9 had suppleness (i.e., capable of bending softly), bulkiness (i.e., higher percent vacancy) and gloss (i.e., higher gloss value), and it also exhibited supple, bulky and glossy hands in the sensuous test.

Example 10

A mass of Sea Island cotton was broken into small pieces by opening, and allowed to pass through a flat carding machine to form a sliver, which was then supplied to a combing machine adjusted so as to leave only longer fibers, thereby obtaining a sliver made of cotton fibers each having a great fiber length. Separately, polyester staple fibers each having a size of 0.7 denier×51 mm were supplied to a flat carding machine to form a sliver, which was then supplied to a drawing frame for preparing a sliver made of raw cotton fibers and polyester staple fibers in admixture at a weight ratio of 50:50. In the same manner as described in Example 9, two single yarns of 20's count each were combined together to form a two folded yarn.

From this polyester-cotton blended yarn, a knit fabric was produced in the same manner as described in Example 9, except that the gray fabric was breached with a solution of sodium hypochlorite.

The knit fabric thus obtained was evaluated for various characteristics in the same manner as described in Example 9. The results are shown in Table 10.

Comparative Example 10

Masses of American cotton, Pakistani cotton and Egyptian cotton were blended by a scutching machine, and allowed to pass through a flat carding machine to form a sliver. Separately, polyester staple fibers each having a size of 0.7 denier×51 mm were supplied to a flat carding machine to form a silver, which was then supplied to a drawing frame for preparing a sliver made of raw cotton fibers and polyester staple fibers in admixture at a weight ratio of 50:50. In the same manner as described in Example 10, two single yarns of 20's count each were combined together to form a two folded yarn, from which a knit fabric was produced.

The knit fabric thus obtained was evaluated for various characteristics. The results are shown in Table 10.

TABLE 10

| Characteristics | Unit | Example 10 | Comp. Ex. 10 |
|---|---|---|---|
| Effective fiber length | inch | 1.89 | 1.28 |
| Micronaire fineness | μg/inch | 3.4 | 3.9 |
| English count | | 20/2 | 20/2 |
| Gauge | needles/inch | 14 | 14 |
| Tensile elongatiion (wale) | % | 16.2 | 13.1 |
| Tensile elongatiion (course) | % | 25.8 | 22.0 |
| Average | % | 21.0 | 17.55 |
| Tensile resilience (wale) | % | 25.0 | 26.8 |
| Tensile resilience (course) | % | 20.3 | 21.2 |
| Average | % | 22.65 | 24.0 |
| Bending rigidity (wale) | gf · cm$^2$/cm | 0.039 | 0.055 |
| Bending rigidity (course) | gf · cm$^2$/cm | 0.020 | 0.025 |
| Average | gf · cm$^2$/cm | 0.0295 | 0.040 |
| Bending hysteresis (wale) | gf · cm/cm | 0.036 | 0.049 |
| Bending hysteresis (course) | gf · cm/cm | 0.016 | 0.024 |
| Average | gf · cm/cm | 0.026 | 0.0365 |
| Shear stiffness (wale) | gf/cm · deg | 0.48 | 0.56 |
| Shear stiffness (course) | gf/cm · deg | 0.42 | 0.53 |
| Average | gf/cm · deg | 0.45 | 0.545 |
| Shear hysteresis (wale) | gf/cm | 2.50 | 2.60 |
| Shear hysteresis (course) | gf/cm | 2.68 | 2.86 |
| Average | gf/cm | 2.59 | 2.73 |
| Mean value of the coefficient of friction (wale) | — | 0.188 | 0.197 |
| Mean value of the coefficient of friction (course) | — | 0.215 | 0.224 |
| Average | — | 0.2015 | 0.2105 |
| Mean deviation of surface roughness (wale) | micron | 4.55 | 4.30 |
| Mean deviation of surface roughness (course) | micron | 15.72 | 14.02 |
| Average | micron | 10.135 | 9.16 |
| Thickness | mm | 1.49 | 1.29 |
| Weight per unit area | gf/m$^2$ | 218 | 213 |
| Gloss value | | 1.2 | 0.9 |
| Sensuous test | | | |
| Suppleness | | ○ | X |
| Bulkiness | | ○ | X |
| Gloss | | ○ | X |

As compared with the conventional knit fabric according to Comparative Example 10, which was produced from raw cotton (Sea Island cotton), the knit fabric according to Example 10 had suppleness (i.e., capable of bending softly), bulkiness (i.e., higher percent vacancy) and gloss (i.e., higher gloss value), and it also exhibited supple, bulky and glossy hands in the sensuous test.

What is claimed is:

1. A cotton fabric made of a spun yarn of 5's to 250's English count comprising cotton fibers, each of which has an effective fiber length of at least 1.8 inches and a micronaire fineness of at most 3.8 μg/inch, the average of bending rigidity values (B) in a warp or wale direction and a weft or course direction of said fabric as measured by a KES-FB2 tester being in the range of 0.002 to 0.100 gf.cm$^2$/cm, and the average of shear stiffness values (G) in a warp or wale direction and a weft or course direction of said fabric as measured by a KES-FB1 tester being in the range of 0.2 to 1.70 gf/cm.degree.

2. A cotton fabric according to claim 1, wherein the spun yarn is of 100's to 250's English count, wherein the average of bending rigidity values is in the range of 0.015 to 0.040 gf.cm$^2$/cm, wherein the average of shear stiffness values is in the range of 0.50 to 1.00 gf/cm.degree, and wherein said fabric is a woven fabric having (i) a cover factor of 20 to 50, (ii) an average of mean values of coefficient of friction (MIU) in warp and weft directions as measured by a KES-FB4 tester in the range of 0.1 to 0.3, and (iii) an average of mean deviations of surface roughness in warp and weft directions as measured by a KES-FB4 tester in the range of 1.0 to 2.0 microns.

3. A cotton fabric according to claim 1, wherein the spun yarn is of 60's to 100's English count, wherein the average of bending rigidity values is in the range of 0.025 to 0.070 gf.cm$^2$/cm, wherein the average of shear stiffness values is in the range of 1.00 to 1.50 gf/cm.degree, and wherein said fabric is a woven fabric having (i) a cover factor of 12 to 40 and (ii) a gloss value as measured by Jeffrie's method using an automatic goniophotometer in the range of 0.6 to 1.2.

4. A cotton fabric according to claim 1, wherein the spun yarn is of 10's to 60's English count, wherein the average of bending rigidity values is in the range of 0.055 to 0.100 gf.cm$^2$/cm, wherein the average of shear stiffness values is in the range of 1.10 to 1.70 gf/cm.degree, wherein said fabric is a woven fabric having (i) a cover factor of 5 to 30, (ii) a gloss value as measured by Jeffrie's method using an automatic goniophotometer in the range of 0.7 to 1.5, and (iii) a warmth retaining factor as measured by a JIS L-1096 warmth retaining test (isothermal method) in the range of 10.0 to 13.0.

5. A cotton fabric according to claim 1, wherein the spun yarn is of 40's to 250's English count, wherein the average of bending rigidity values is in the range of 0.002 to 0.050 gf.cm$^2$/cm, wherein the average of shear stiffness values is in the range of 0.30 to 1.20 gf/cm.degree, wherein said fabric is a knit fabric having a gloss value as measured by Jeffrie's method using an automatic goniophotometer in the range of 0.6 to 1.2.

6. A cotton fabric according to claim 1, wherein the spun yarn is of 5's to 40's English count, wherein the average of bending rigidity values is in the range of 0.005 to 0.100 gf.cm$^2$/cm, wherein the average of shear stiffness values is in the range of 0.2 to 1.10 gf/cm.degree, wherein said fabric is a knit fabric having (i) a percent vacancy (EMC) as measured by a KES-FB3 tester in the range of 30% to 50% and (ii) a gloss value as measured by Jeffrie's method using an automatic goniophotometer in the range of 0.8 to 1.6.

* * * * *